US006403216B1

(12) United States Patent
Doi et al.

(10) Patent No.: US 6,403,216 B1
(45) Date of Patent: Jun. 11, 2002

(54) MOISTURE-ABSORBING/RELEASING SYNTHETIC FIBER AND FABRIC USING THE SAME

(75) Inventors: Masanori Doi; Takeshi Sugaya; Sueo Ohashi, all of Moriyama (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 09/913,024

(22) PCT Filed: Feb. 10, 2000

(86) PCT No.: PCT/JP00/00766

§ 371 (c)(1),
(2), (4) Date: Aug. 9, 2001

(87) PCT Pub. No.: WO00/47802

PCT Pub. Date: Aug. 17, 2000

(30) Foreign Application Priority Data

Feb. 12, 1999 (JP) ..... 11-34593
Sep. 2, 1999 (JP) ..... 11-249226

(51) Int. Cl.[7] ..... D02F 6/00; D01F 6/70; D01F 6/72; C08G 18/10

(52) U.S. Cl. ..... 428/364; 428/394; 528/52; 528/55; 528/57; 528/61; 528/65; 528/80

(58) Field of Search ..... 428/364, 394; 528/52, 55, 57, 61, 65, 66, 80

(56) References Cited

U.S. PATENT DOCUMENTS 4,442,173 A 4/1984 Takegami et al.
5,919,564 A * 7/1999 Sugaya et al. ..... 528/55
6,284,370 B1 * 9/2001 Fujimoto et al. ..... 428/364

FOREIGN PATENT DOCUMENTS

| | | |
|---|---|---|
| EP | 0 892 094 A2 | 1/1999 |
| EP | 1 087 043 | 3/2000 |
| JP | 60-457 | 1/1985 |
| JP | 60-215835 | 10/1985 |
| JP | 60-40612 | 12/1985 |
| JP | 2-99612 | 4/1990 |
| JP | 4-361616 | 12/1992 |
| JP | 4-361617 | 12/1992 |
| JP | 5-271432 | 10/1993 |
| JP | 9-41204 | 2/1997 |
| JP | 9-41221 | 2/1997 |
| JP | 10-331034 | 12/1998 |
| JP | 11-279871 | 10/1999 |
| JP | 2000-96343 | 4/2000 |

* cited by examiner

*Primary Examiner*—Newton Edwards
(74) *Attorney, Agent, or Firm*—Finnegan, Henderson, Farabow, Garrett & Dunner, L.L.P.

(57) ABSTRACT

A synthetic fiber which is excellent in moisture-absorbing/releasing property and exhibits high elongation and high stretch recovery, characterized in that it has moisture absorption ratios of 0.5 to 4.0% by weight in environments of 20° C.×65% RH and that of 4.5% by weight or more in environments of 30° C.×90% RH, respectively, and also has a difference between the absorption ratios in both the environments of 4.0% by weight or more. The representative examples of such fibers include polyurethane synthetic fiber and polyether synthetic fiber. The synthetic fiber maintains a high strength at break of an elastic fiber component thereof also in the state of having absorbed moisture, is excellent in color fastness to rubbing, and can be used for manufacturing a stretch fiber fabric product excellent in comfort through blending with another fiber material. The synthetic fiber can be produced by incorporating a water absorption resin having a water absorption ratio in a range from 500 to 4000% by weight into an elastic fiber such as a polyurethane fiber or a polyurethane-urea fiber in a finely dispersed state in an amount in a range from 1 to 15% by weight relative to a fiber-forming polymer.

20 Claims, 4 Drawing Sheets

MOISTURE-ABSORBING/RELEASING SYNTHETIC FIBER AND FABRIC USING THE SAME

TECHNICAL FIELD

The present invention relates to a high elongation and high stretch-recovery synthetic fiber suitable for preparing clothing free from stuffiness and excellent in comfort, more particularly to a high elongation and high stretch-recovery synthetic fiber suitably used for a clothing such as an inner wear, a hosiery, an intermediate a sport wear, or the like, having such as polyurethane type synthetic fiber excellent in moisture absorbing/releasing property, wet fastness to rubbing and strength-retaining ratio under wet conditions, a method for producing the same and a fabric using such a fiber.

BACKGROUND ART

It is well-known that the wearing comfort of clothing is improved by using a synthetic fiber imparted with a moisture absorbing property, a water-absorbing property, a moisture releasing property, a moisture permeability or others so that the discomfort due to sweat in the clothing is mitigated. When clothing such as inner-wear, a hosiery, intermediate wear, sportswear or others is worn in direct contact with, or close to, human skin, it is possible to impart the clothing with a function for promptly releasing sweat out of the clothing by applying this prior art, whereby cool clothing free from stuffiness and a clinging feel, even if the wearer sweats, is obtainable.

Attempts for imparting synthetic fibers with a moisture absorbing property, a water-absorbing property, a moisture releasing property, a moisture permeability or others have been often related to polyamide and polyester type synthetic fibers. For example, Japanese Examined Patent Publication (Kokoku) No. 60-457 discloses a composite yarn composed of a high moisture absorbent filament and a low moisture absorbent fiber, and Japanese Examined Utility Model (Kokoku) Publication No. 60-40612, Japanese Unexamined Patent Publication (Kokai) No. 60-215835 discloses knit and woven fabrics using the above-mentioned composite yarn. In Japanese Unexamined Patent Publication (Kokai) No. 2-99612, No. 4-361616, No. 4-361617, No. 9-41204, No. 9-41221 and others, synthetic fiber fabrics improved in moisture absorbing property are disclosed which use a sheath-core type composite fiber obtained by a composite spinning wherein a high moisture absorbent resin is disposed as a core around which is arranged a non- or low-moisture absorbent resin. In the above prior art, there is a disclosure in that, if a ratio of the high moisture absorbent core encircled by the low moisture absorbent sheath polyester resin becomes higher, the core resin is swollen with water when moistened or dyed to expand the sheath, whereby cracks are generated in the fiber to destroy and damage the fiber structure, resulting in the deterioration of physical properties such as a mechanical strength when the fiber is subjected to a wet treatment such as dyeing or is worn by a wearer. In the above Japanese Unexamined Patent Publication (Kokai) No. 9-41204 and No. 9-41221, a design of a sheath-core type composite fiber is disclosed wherein a polyamide inherently moisture absorbent to some extent is used as a core and a fiber cross-section is non-circular so that sweat is guided from a skin surface to a fabric due to a capillary action and then is absorbed into the moisture absorbent core resin while accelerating the release of the moisture out of the clothing. Even in this design, however, it is said that there may be the deterioration of mechanical strength during the dyeing process due to the swelling of core resin. For the above reasons, it is apparent that the sheath-core type fiber structure design is not applicable for modifying a high elongation and high stretch-recovery synthetic fiber in which the elongation of the fiber is as large as several hundreds of %.

Moisture absorbent synthetic fibers have been known, such as an acrylic type composite fiber with a salt type carboxylic group being introduced into a surface layer, a polyacrylate type fiber, a maleic anhydride type fiber, a polyvinyl alcohol type fiber, an alginate type fiber, or a polyurethane fiber, each composed of a polymer having a water absorbent group in a molecule.

Most of high elongation and high stretch-recovery synthetic fibers such as polyurethane type synthetic fiber or polyether-ester type synthetic fiber are used in the form of an elastic fabric exhibiting a high stretchability obtained by mixing the same with polyamide type synthetic fiber, polyester type synthetic fiber, regenerated cellulosic fiber, cotton, silk, wool or others. This elastic fabric is tailored to a stretchable clothing simultaneously satisfying a well-fitted feeling, a motion follow-up ability and wearing comfort. Because the stretchable clothing is designed so that the elastic fabric always fits a human body, a space between the human body and the fabric in tight contact therewith must be small. For the above reason, and based on requirements for the design of stretchable clothing, the stretchable clothing has an disadvantage in that it is liable to be stuffy to lower the comfort. Thus, there is a reason in that a high elongation and high stretch-recovery synthetic fiber must be moisture absorbable, water absorbable and moisture releasable as well as being moisture-permeable.

As a stretchable clothing which requires close contact of a human body with a fabric, an elastic fabric must have a high color fastness, for example, to rubbing caused by other clothing superposed thereon. For instance, it is said that in the superposed clothing mixedly knit or woven with natural fiber such as silk or polyamide type synthetic fiber, color staining is generally liable to occur by the frictional contact with an elastic fabric in general having an inferior color fastness in a high temperature and high humidity atmosphere because the higher the water absorption ratio of the fiber, the lower a color fastness to rubbing in a wet condition (hereinafter merely referred to a fastness to rubbing), the improvement of the color fastness of the synthetic fiber having a high elongation and a high stretchability is also desired in this respect.

A polyurethane yarn is disclosed in EP 0,892,094 A2, having a water absorption ratio in a range from 200 to 3,000% by weight (at 25° C.) obtained by melt-spinning polyurethane containing water-soluble polyalkylene-ether-polyol having a number-average molecular weight in a range from 2,000 to 13,000 in a polymer molecule. According to Examples or others in this publication, there is a description in that this known water absorbent polyurethane fiber is poor in tensile strength when swollen. It could be said that a fiber having the water absorption ratio exceeding 200% by weight at 25° C. and inferior in physical property when swollen is liable to absorb water during the dyeing process to cause fiber breakage, and a polyurethane yarn composed thereof is liable to break when clothing made thereof is worn or the clothing (such as a swim suit) becomes heavy when it absorbs water to deteriorate the comfort as well as worsen the color fastness to rubbing in a wet condition. Also, according to the knowledge of the present inventors, as stated later, a fiber large in water absorption ratio is not always a fiber high in moisture-releasing ability.

Kokai No. 5-271432 discloses that the moisture-permeability is improved and the curling of the fabric is minimized by using a compound in which magnesium salt is dissolved in polyurethane polymer. However, a polyurethane article thus obtained is significantly reduced in mechanical strength when it absorbs moisture, and the moisture is difficult to release once it is absorbed, whereby the comfort is hardly improved when the wearer sweats, and a high color fastness is not obtained.

DISCLOSURE OF THE INVENTION

An object of the present invention is to provide a high elongation and high stretch-recovery synthetic fiber which is low in strength deterioration when moistened and improved in moisture releasing property, and a fabric made of such a fiber. A more concrete object of the present invention is to provide a high elongation and high stretch-recovery synthetic fiber suitable for producing a fabric for clothing use, maintaining a good processability during a wet treatment such as a dyeing process, which fiber is free from stuffiness and rich in stretchability to result in an excellent wearing comfort, and a fabric using such a fiber.

DETAILED DESCRIPTION OF THE INVENTION

Figure 1:
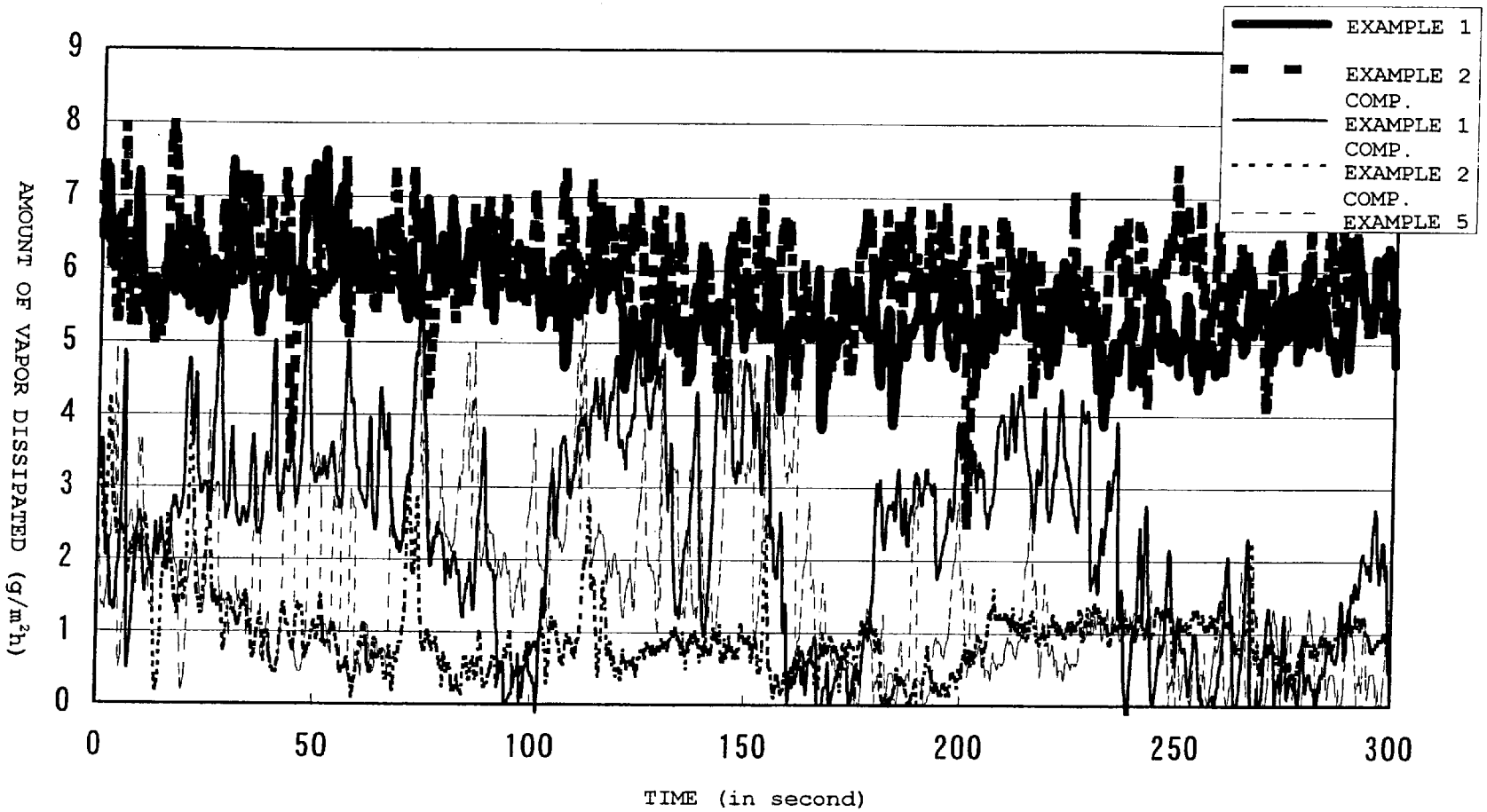
FIG. 1 is graphs showing an amount of water evaporated from a wearer of panty hose compositely knit from fibers according to Examples according to the present invention and Comparative examples, respectively, who stationarily sits on a chair in an environment at a room temperature of 26° C. and a relative humidity of 60% RH.

An object of the present invention is achievable by a high elongation and high stretch-recovery synthetic fiber, wherein a moisture absorption ratio is in a range from 0.5 to 4.0% by weight at 20° C.×65% RH (relative humidity) and 4.5% by weight or more at 30° C.×90% RH (relative humidity), and the difference in moisture absorption ratio between both the conditions is 4.0% by weight or more.

The high elongation and high stretch-recovery synthetic fiber according to the present invention is an improved fiber excellent in moisture absorbing/releasing property and dyeable to have a good color fastness without the substantial deterioration of physical properties such as a mechanical strength under a wet condition such as that of a dyeing treatment suitably used for producing a stretch clothing.

One of the advantages of the present invention is that the fiber having the above-mentioned characteristics can be prepared by spinning a base material for the known high elongation and high stretch-recovery synthetic fiber added with a selected amount of a compound having a high moisture absorption ratio.

The high elongation and high stretch-recovery synthetic fiber referred to in the present invention includes a polyurethane type synthetic fiber, polyether-ester type synthetic fiber, and a textured yarn of polyester or polyamide type synthetic fiber. The high elongation and high stretch-recovery synthetic fiber referred to in this text is, in general, a synthetic fiber having an elongation at break of 300% or more and an elastic recovery of 70% or more and is suitable for obtaining a fabric rich in stretchability and excellent in a well-fitted feeling to result in comfortable wear, and is preferably an elastic fiber having a physical property for satisfying at least such a physical property level as mentioned-above. In the high elongation and high stretch-recovery synthetic fiber according to the present invention, the fiber preferably exhibits an elongation at break of 450% or more and a elastic recovery of 80% or more.

The high elongation and high stretch-recovery synthetic fiber having an elongation at break of 300% or more and an elastic recovery of 70% or more may be produced by applying a known dry type spinning method, wet type spinning method or melt-spinning method while combining the following modifying means therewith, to a fiber-forming polyurethane type or polyether-ester type polymer prepared by using a known method described later.

The moisture absorbing/releasing property of the high elongation and high stretch-recovery synthetic fiber is adjustable by blending a desired amount of a compound having a high water absorption ratio (hereinafter referred to as a water absorption resin) with the synthetic fiber or introducing a desired amount of hygroscopic functional group into the polymer. As means for introducing a moisture absorption modifier, a blending method is preferably used, which gives less change in physical properties of the polymer in view of a design of mechanical properties of the polymer. The water absorption resin used in the blending method is suitably a resin having a water absorption ratio in a range from 500 to 4,000% by weight. If the water absorption ratio of the water absorption resin used as a modifier is less than 500% by weight, it is impossible to obtain a sufficient moisture absorbing/releasing property, while, if exceeding 4,000% by weight, the physical properties such as a mechanical strength of the synthetic fiber may largely lower.

The water absorption resins include a urethane type water absorption resin, a starch type water absorption resin, an acrylate type water absorption resin, a polyvinyl alcohol type water absorption resin, a polyvinyl pyrrolidone type water absorption resin, a polyether ester type water absorption resin, a polyether amide type water absorption resin, a polyether imide-amide type water absorption resin, a polyether ester amide type water absorption resin or others. Of the above water absorption resins, those excellent in compatibility with synthetic fiber or in dispersibility in the fiber are preferable. The most preferable resin is that capable of forming a micro-phase separated structure together with the fiber polymer. The water absorption resin readily developing such a characteristic is of an urethane type. An amount of water absorption resin to be blended in the blending method must be at least 5% by weight of the fiber-forming polymer for guaranteeing the minimum moisture absorbing/releasing property although it may vary in accordance with water absorption capacities due to the modifying resin. To facilitate the high elongation and high stretch-recovery of the fiber-forming polymer, the content of the water absorption resin is preferably 40% by weight or less. While the mixture of the water absorption resin in the fiber may be carried out by uniformly blending the molten water absorption resin or that dissolved in a solvent or by uniformly dispersing the atomized water absorption resin, the former method is preferable because it can readily form the micro-phase separated structure.

The high elongation and high stretch recovery synthetic fiber having a moisture absorbing/releasing property according to the present invention will be described in more detail below.

Regarding the moisture absorbing/releasing property of the high elongation and high stretch recovery synthetic fiber, it is necessary to control an amount of high water absorption compound to be blended or an amount of high water absorption component to be grafted so that the moisture absorption ratio is in a range from 0.5 to 4.0% by weight at 20° C.×65% RH (hereinafter referred to as an atmosphere A) and in a range from 4.5 to 30% by weight at 30C.×90% RH (hereinafter referred to as an atmosphere B), and the difference in moisture absorption ratio between both the atmospheres is 4.0% by weight or more.

If the difference in moisture absorption ratio of the high elongation and high stretch recovery synthetic fiber between both the atmospheres A and B (hereinafter referred to as a moisture absorbing/releasing ability) is 4.0% by weight or more, it is possible to feel coolness when a fabric using this synthetic fiber is worn as clothing. This value determines a capacity for absorbing sweat from a human skin, and the larger this value, the higher the moisture absorbing/releasing capacity. The moisture absorbing/releasing capacity is preferably 10% by weight or more. The moisture absorption ratio in the atmosphere A may be 0.5% by weight or more. The higher this value, the more the moisture is contained in a fabric. In such a case, since the wearer feels coldness if this fabric is in direct contact or closer to a human skin when it is worn, the moisture absorption ratio is preferably 4.0% by weight or less.

On the other hand, the moisture absorption ratio in the atmosphere B is preferably in a range from 4.5 to 30% by weight. If the moisture absorption ratio is less than 4.5% by weight, sufficient moisture is not obtainable and the wearer does not feel coolness, while if exceeding 30% by weight, there are problems in that the strength excessively lowers, a feeling that a fabric clings to a skin increases or the color fastness to rubbing in a wet condition and a strength-retaining ratio are deteriorated as described below. Even if the moisture absorption ratio is in a range from 4.5 to 30% by weight in the atmosphere B, the strength-retaining ratio and the color fastness to rubbing in a wet condition deteriorate unless the moisture absorption ratio is in a range from 0.5 to 4.0% by weight in the atmosphere A.

The present invention is characterized in that the high elongation and high stretch recovery synthetic fiber having a moisture absorbing/releasing property in the above-mentioned range has the strength-retaining ratio in the atmosphere B of 90% or more relative to that in the atmosphere A. While the water absorption polyurethane yarn disclosed in EP 0,892,094 A2 has an extremely high water absorption ratio in a range from 200 to 3000%, this corresponds in the atmosphere A, according to the present invention, to the moisture absorption ratio of 10% by weight which imparts the wearer with coldness, while in the atmosphere B, corresponds to the moisture absorption ratio of 50% by weight or more which imparts the wearer with a feeling that a fabric clings to a skin.

In the prior art, a high elongation and high stretch-recovery synthetic fiber sufficiently satisfactory in moisture absorbing property was not obtainable merely by facilitating the moisture absorbing/releasing property, because of the deterioration of strength-retaining ratio and/or color fastness in a wet condition.

The most favorable aspect of the high elongation and high stretch-recovery synthetic fiber according to the present invention is a polyurethane type synthetic fiber obtained by a dry spinning method. The polyurethane type synthetic fiber contains 80% or more of soft segments consisting of urethane links, and is most excellent in elongation and stretch-recovery whereby no physical property is deteriorated even though it deforms when moistened. The dry spinning method is the most advantageous spinning method capable of easily forming a higher-order structure which is strong physical cross-linking, in comparison with a wet spinning method, and of facilitating a wet strength. Of them, a polyurethane-urea type synthetic fiber is most favorable, which is particularly high in elongation and in stretch-recovery and obtained by the dry spinning method (hereinafter referred to as a polyurethane-urea elastic fiber).

Embodiments of the present invention will be described below in more detail with reference mainly to the polyurethane type synthetic fiber.

A modified fiber having the strength-retaining ratio in the atmosphere B of 90% or more relative to that in the atmosphere A is easily obtainable by the high elongation and high stretch-recovery polyurethane type synthetic fiber spun by a dry spinning method, having a moisture absorbing/releasing property in a specified range according to the present invention. If the fiber strength is lowered when moistened, fiber breakage is liable to occur during the wet treatment, or while a clothing made of the fiber is worn to worsen the wearing comfort. If the strength-retaining ratio in the atmosphere B is 90% or more relative to that in the atmosphere A, there is no such a problem. Since the water absorption polyurethane yarn disclosed in EP 0,892,094 A2 is as high as 200 to 3,000%, the strength-retaining ratio in the atmosphere B relative to that in the atmosphere A is 50% or less.

While it is uncertain why the synthetic fiber according to the present invention has a good strength-retaining ratio, it is surmised that in the urethane type synthetic fiber spun by a dry method, a hydrogen bond, which is a strong physical crosslink, effectively operates when the moisture absorption ratio is in the specific range. Outside this range, the hydrogen bond will be cut by the closer affinity with water when the moisture is absorbed to lower the strength.

Regarding the moisture absorbing/releasing property of the polyurethane type synthetic fiber according to the present invention, it is necessary to control an amount of high moisture absorption compound to be blended or an amount of high moisture absorption component to be grafted so that the moisture absorption ratio in an atmosphere at 20° C.×65% RH (hereinafter referred to as atmosphere A) is in a range from 0.5 to 4.0% by weight, the moisture absorption ratio in an atmosphere at 30° C.×90% RH (hereinafter referred to as atmosphere B) is in a range from 4.5 to 30% by weight, and the difference in moisture absorption ratios between both the conditions is 4.0% by weight or more.

Generally speaking, when the moisture absorption material is used for clothing, the color fastness to rubbing in a wet condition becomes worse by the friction with other clothing, for example, of cotton, silk or others. For instance, the color fastness to rubbing in a wet condition of a conventional polyurethane type synthetic fiber now on the market is grade 3, that of the moisture absorption polyurethane disclosed in Kokai No. 5-271432 is in a range from grade 1 to 2, and that of the water absorption polyurethane yarn disclosed in EP 0,892,094 A2 is in a range from grade 1 to 2. The color fastness to rubbing in a wet condition of material used for a clothing must be grade 3 or more. It is possible to obtain a dyed product of the polyurethane type synthetic fiber according to the present invention having the color fastness to rubbing in a wet condition of grade 4 or more. Such a dyed product having a high grade color fastness to rubbing in a wet condition is obtainable by acid dyes including a levelling type, a half-milling type, a milling type, a monosulfonic metallized type and a nonsulfonic metallized type. The improvement in color fastness to rubbing in a wet condition is also apparently discernible in disperse dyes, cationic dyes, direct dyes and reactive dyes although not so significant as acid dyes.

While it is uncertain why the color fastness of the synthetic fiber according to the present invention to rubbing in a wet condition is improved, it is surmised that, when the fiber absorbs water to an extent defined by a specific range of moisture absorption ratio, the affinity between the dye and the fiber polymer becomes most favorable to hardly release the dye.

The technique for imparting the high elongation and high stretch-recovery synthetic fiber with the moisture absorbing/releasing property varies in accordance with the spinning methods for obtaining the fiber.

Initially, the preparation of a synthetic fiber by dry spinning, as in a case of polyurethane-urea elastic fiber, will be described. In this case, since a process exists for preparing a spinning dope by dissolving polyurethane polymer in an amide type polar solvent, a water absorption resin component is preferably dissolved in the solvent. For example, urethane type water absorption resin, polyvinyl pyrrolidone type water absorption resin or the like is preferable. If a water absorption resin is obtainable, having a particle size as small as not to cause trouble such as yarn breakage during the dry spinning process, it may be used without being dissolved in the amide type polar solvent. For instance, starch type resin, acrylate type resin, polyether ester-amide type water absorption resin or the like may be used. Also, it is possible to impart a polyurethane-urea polymer with water absorption by replacing part of the components of the former with a component having a high water absorbing property. For example, part of polytetramethylene glycol used as diol may be replaced by polyethylene glycol. Also, a polyurethane type synthetic fiber in which a hard segment consists of urethane bonds, obtained by a dry spinning method is imparted with the moisture absorbing/releasing property in the same manner as in the polyurethane-urea elastic fiber.

In polyurethane type and polyether-ester type synthetic fibers obtained by an ordinary melt-spinning method, there is no limitation in water absorption resins to be blended or water absorption components to be graft-polymerized unless they adversely influence the production process.

Favorable examples of the urethane type water absorption resins to be blended are resins obtained by the reaction of the following compounds (a) and (b) or (a) to (c);

(a) high molecular-weight diol containing 50% by weight or more of polyalkylene-ether glycol which has a number-average molecular weight in a range from 2000 to 30000 and contains ethylene oxide units of at least 70% by weight, (b) organic diisocyanate, and (c) low molecular-weight diol having a number-average molecular weight in a range from 50 to 200 or bifunctional amine.

While the urethane type water absorption resin obtained by the reaction of (a) and (b) is excellent in water absorption ratio, sometimes an amount of water-soluble component may somewhat increase or a moisture-releasing rate may become low. While (c) functions as a chain extender, it is liable to form a physical cross-linking to disturb the swelling of the water absorption resin. However, by taking account of a balance between the restriction of an amount of water-soluble component in the resin and the moisture absorbing/releasing ability, the best resin is one using bifunctional amine as (c), the second best is one using none of (c), and the third is one using low molecular weight diol. The number-average molecular weight of the urethane type water absorption resin is freely adjustable by changing a molar ratio of reaction between (a), (b) and (c). The number-average molecular weight is preferably 7,000 or more. If it is less than 7,000, an oligomer component is eluted from a synthetic fiber according to the present invention during the dyeing process to contaminate a dye bath or the moistened oligomer worsens the color fastness to rubbing in a wet condition. On the other hand, if the number-average molecular weight exceeds 300000, the resin becomes difficult to swell to lower the water absorption ratio. To uniformly blend the water absorption resin in the polyurethane type synthetic fiber according to the present invention, a method is preferably adopted wherein the resin is dissolved in an amide type polar solvent such as dimethylacetamide and added to the synthetic fiber. However, if the resin is not soluble into the amide type solvent, it may be pulverized to particles of 5 $\mu$m or less and then uniformly dispersed into the synthetic fiber.

More specifically, polyalkylene glycol in a high molecular-weight diol may contain less than 30% by weight of, for example, 1, 2-propyleneoxide unit, 2,2-dimethylpropyleneoxide unit, tetramethyleneoxide unit in a diol molecular chain. However, polyethylene glycol composed solely of ethyleneoxide units is most preferable. The number-average molecular weight of high molecular-weight diol is preferably in a range from 2,000 to 30,000, more preferably from 5,000 to 20,000. Glycol such as polypropylene-ether glycol, polytetramethylene-ether glycol, polyoxypentamethylene glycol, copolymerized polyether glycol composed of tetramethylene group and 2, 2-dimethylpropylene group, copolymerized polyether glycol composed of tetramethylene group and 3-methyltetramethylene group may be blended in a range not exceeding 50% by weight. However, such a blend is not preferable to realize a high water absorption ratio.

Organic diisocyanate includes, for example, trimethylene diisocyanate, tetramethylene diisocyanate, pentamethylene diisocyanate, hexamethylene diisocyanate, 3-methylhexane-1,6-diisocyanate, 3,3'-dimethylpentane-1,5-diisocyanate, 1,3- and 1,4-cyclohexylene-diisocyanate, 4,4'-dicyclohexylmethane diisocyanate, m- and p-xylylene diisocyanate,$\alpha$, $\alpha$, $\alpha'$,$\alpha'$-tetramethyl-p-xylylene diisocyanate, 4,4'-diphenylmethane diisocyanate, isophorone diisocyanate, and 2, 4-tolylene diisocyanate. Of them, 4,4'-diphenylmethane diisocyanate and 4,4'-dicyclohexylmethane diisocyanate are preferable. These may be used alone or mixed with each other.

A low molecular weight diol has a molecular weight in a range from 50 to 200, and includes, for example, ethylene glycol, 1,2-propylene glycol, 1,3-propylene glycol, 1,3-butane diol, 1,4-butane diol, 1,5-pentane diol, 1,6-hexane diol, 2,2-dimethyl-1,3-propane diol, diethylene glycol, dipropylene glycol, 1,4-cyclohexane dimethanol, and phenyldiethanol amine. Of them, 1,4-butane diol and ethylene glycol are preferable. These may be used alone or mixed with each other.

A bifunctional amine includes, for example, ethylene diamine, 1,2-propylene diamine, 1,3-propylene diamine, 2-methyl-1,5-penta diamine, triethylene diamine, m-xylylene diamine, piperazine, o-, m- and p-phenylene diamine, 1,3-diaminocyclohexane, 1,4-diaminocyclohexane, 1,6-hexamethylene diamine and N,N'-(methylene di-4,1-phenylene)bis[2-(ethylamino)-urea], and mixtures thereof. Of them, one selected from ethylene diamine and 1,2-propylene diamine is preferable.

Examples of the urethane type water absorption resin are a resin having a number-average molecular weight of 60000 (having the water absorption ratio of 1800% by weight) obtained by reacting polyethylene glycol having a number-average molecular weight of 7000, 1,4-butane diol and 4,4'-diphenylmethane diisocyanate with each other, and a resin (having the water absorption ratio of 800% by weight) obtained by reacting polyethylene glycol having a number-average molecular weight of 20000 and 4,4'-diphenylmethane diisocyanate.

The high elongation and high stretch-recovery polyurethane type synthetic fiber according to the present invention may be further improved in strength-retaining ratio, and color fastness to rubbing in a wet condition, by mixing a water absorption resin obtained by adding a urea compound in a range from 1 to 15% resulted from the reaction of the following components (A) to (C) by weight to a polyurethane type polymer:

(A) Nitrogen-contained compound containing a bifunctional amino group selected from at least one kind of a primary amine and a secondary amine and a nitrogen-contained group selected from at least one kind of a tertiary nitrogen and a heterocyclic nitrogen;

(B) organic diisocyanate; and (C) a kind of compound selected from the group of mono-, di-alkylmonoamine, alkylmonoalcohol and organic monoisocyanate.

While the high elongation and high stretch-recovery polyurethane type synthetic fiber is often mixedly knit or woven with polyamide fiber, polyester fiber, cotton, wool, silk or others to form a fabric, the former fiber shrinks more during the dyeing process than the other fibers and is difficult to heat-set, whereby there is a problem in that it is difficult to finish the fabric at a predetermined fabric width. The urea compound according to the present invention can solve such a problem.

A number-average molecular weight of the urea compound is freely adjustable by changing a molar ratio of reaction between (A), (B) and (C). The urea compound is preferably dissolved in a dope of polyurethane type polymer to be subjected to a dry spinning. Therefore, a number-average molecular weight of the urea compound may be one capable of being dissolved in an amide type polar solvent, preferably in a range from 500 to 10,000, more preferably from 500 to 3,000.

A nitrogen-contained compound used for the urea compound includes N-butyl-bis(2-aminoethyl) amine, N-butyl-bis(2-aminopropyl) amine, N-butyl-bis(2-aminobutyl) amine, N,N-bis(2-aminoethyl)-isobutylamine, N,N-bis(2-aminopropyl)-isobutylamine, N,N-bis(2-aminoethyl)-t-butylamine, N,N-bis(2-aminoethyl)-1,1-dimethylpropylamine, N,N-bis(2-aminopropyl)-1,1-dimethylpropylamine, N,N-bis(2-aminobutyl)-1,1-dimethylpropylamine, N-(N,N-diethyl-3-aminopropyl)-bis(2-aminoethyl) amine, N-(N,N-dibutyl-3-aminopropyl)-bis(2-aminopropyl) amine, piperazine, piperazine derivatives such as 2-methylpiperazine, 1-(2-aminoethyl)-4-(3-aminopropyl) piperazine, 2, 5- and 2,6-dimethylpiperazine, N,N'-bis(2-aminoethyl) piperazine, N,N'-bis(3-aminopropyl) piperazine, N-(2-aminoethyl) piperazine or N-amino-(2-aminoethyl)-4-methylpiperazine, piperidine derivatives such as 4-aminoethylpiperidine, N-amino-4-(2-aminoethyl) piperidine or N-bis(2-aminoethyl) amine-piperidine, and pyrrolidone derivatives such as N-amino-4-(2-aminoethyl)-2-pyrrolidone, N-(3-aminopropyl)-4-(3-aminopropyl)-2-pyrrolidone or N-bis(2-aminoethyl) amine-2-pyrrolidone. Of them, piperazine and piperazine derivatives are preferable nitrogen-contained compounds. Particularly, N-(2-aminoethyl) piperazine and N-(2-aminopropyl) piperazine are preferable because the urea compound obtained therefrom has an extremely favorable solubility in the amide type solvent. They are usable alone or in a mixture form.

An organic diisocyanate used for the urea compound according to the present invention includes trimethylene diisocyanate, tetramethylene diisocyanate, pentamethylene diisocyanate, hexamethylene diisocyanate, 3-methylhexane-1,6-diisocyanate, 3,3'-dimethylpentane-1,5-diisocyanate, 1,3- and 1,4-cyclohexylene diisocyanate, 4,4'-dicyclohexylmethane diisocyanate, m- and p-xylylene diisocyanate,$\alpha,\alpha,\alpha',\alpha'$-tetramethyl-p-xylylene diisocyanate, 4,4'-diphenylmethane diisocyanate, isophorone diisocyanate, 2,4-tolylene diisocyanate or others. Preferably, alicyclic diisocyanate such as isophorone diisocyanate or 4,4'-dicyclohexylmethane diisocyanate. They are usable alone or in a mixture form.

Mono- or di-alkylmonoamine used for the urea compound according to the present invention has alkyl group, carbon number 1 to 10, and includes, for example, isopropyl amine, n-butyl amine, t-butyl amine, diethyl amine, 2-hexyl amine, di-isopropyl amine, di-n-butyl amine, di-t-butyl amine, di-isobutyl amine, di-2-ethylhexyl amine or others. Also the alkyl group may be contained a tertiary nitrogen or oxygen and the monoamine includes, for example, 3-dibutylamino-propylamine, 3-diethylamino-propylamine, 3-ethoxypropylamine, 3-(2-ethylhexyloxy)propylamine. These may be used alone or in a mixed form.

Alkylmonoalcohol used for the urea compound according to the present invention has alkyl group, carbon 1 to 10, and includes, for example, methanol, ethanol, 2-propanol, 2-methyl-2-propanol, 1-butanol, 2-ethyl-1-hexanol, 3-methyl-1-butanol or others. These may be used alone or in a mixed form.

The above-mentioned mono- or di-alkylamine or alkylalcohol may be used alone or in a mixed form. However, they are preferably used in a single form.

Further, the organic mono-isocianate used for the urea compound according to the present invention includes n-butyl isocyanate, phenyl isocyanate, 1-naphthyl isocyanate, p-chlorophenyl isocyanate, cyclohexyl isocyanate, m-tolyle isocyanate, benzyl isocyanate, m-nitrophenyl isocyanate or others. They are usable alone or in a mixture form. However, they are not usable mixed with the above-mentioned mono- or di-alkylamine or alkylalcohol. This is because an oligomer compound is generated, in which active hydrogen in mono- or di-alkylamine or alkylalcohol is hindered by organic monoisocyanate, and bleeds out during a treatment process for the urethane type synthetic fiber according to the present invention to cause a scum contaminating a knitting machine or a dye bath.

As described before, (C) used for preparing the urea compound according to the present invention is selected from the three kinds of components for the purpose of hindering an active end (amino group or isocyanate group) of the urea compound obtained from (A) and (B). The active end worsens the spinning stability of polyurethane type synthetic fiber. If a molar equivalent weight of reaction of (A) is larger than that of (B), organic mono-isocyanate must be selected as (C) because the end of the urea compound is amino group, and if that of (A) is smaller than that of (B), at least one kind of mono- or di-alkylamine and alkylmonoalcohol must be selected as (C) because the end of the urea compound is an isocyanate group. An organic mono-isocyanate is preferably selected.

In one example of reaction for obtaining the urea compound, N-(2-aminoethyl) piperazine of 2 mol as (A), isophorone diisocyanate of 1 mol as (B) and phenyl isocyanate of 2 mol as (C) are reacted for 2 hours at 50° C. to form a 50% by weight dimethylacetamide solution. The reaction is carried out by dropping isophorone diisocyanate and phenyl isocyanate into N-(2-aminoethyl) piperazine dissolved in dimethylacetamide. However, the reaction method should not be limited thereto but may adopt any other known method.

An amount of the urea compound used in the present invention is preferably 20% by weight or more relative to water absorption resin. If it is less than 20% by weight, no improvement is obtained at all in a strength-retaining ratio and a color fastness to rubbing in a wet condition. Since an amount of water absorption resin to be added to the polyurethane type polymer must be 5% by weight or more, an amount of the urea compound to be added to the polyurethane type polymer must be 1% by weight or more. If the urea compound exceeding 15% by weight is added to the polyurethane type polymer, the spinning stability becomes worse due to yarn breakage or others as well as mechanical properties such as strength, elongation, stretch-recovery or the like may be deteriorated. Thus, the amount of the urea compound to be added to the polyurethane is preferably in a range from 1 to 15% by weight, more preferably from 2 to 10% by weight.

If at least one kind of polyacrylonitrile type polymer, polyurethane polymer and styrene-maleic anhydride copolymer described in Kokai No. 7-316922 is contained in the polyurethane type synthetic fiber, besides the urea compound according to the present invention, the strength-retaining ratio and the color fastness to rubbing in a wet condition is less improved than in the urea compound. Also, the heat-set effect is less improved than in the urea compound. Of them, polyurethane polymer is the most preferable thermoplastic polymer. These thermoplastic polymers may be used together with the urea compound according to the present invention. However, the total amount to be added preferably does not exceed 15% by weight.

When the urethane type water absorption resin, the urea compound and the compound disclosed in Kokai No. 7-316922 are added to the polyurethane type synthetic fiber, a solution is preferably used, which has passed through a filter having a high filtration accuracy after being dissolved into amide type polar solvent. When these compounds are synthesized, gel is necessarily generated due to the secondary reaction and disturbs the spinning stability in the dry spinning process to cause yarn breakage or others. A filter used for this purpose is preferably a multi-layered sintered filter made of stainless steel fibers rather than a metallic net of a plain weave or a twill weave. If the polyurethane dope just before the spinning is filtrated through this filter, the spinning stability is further enhanced. The filter preferably removes 95% or more of gel having a size of 40 $\mu$m or smaller.

To obtain the polyurethane type polymer in the polyurethane type synthetic fiber, a known technique may be used, wherein, after a urethane intermediate-polymer, as a soft segment, is synthesized by the reaction of polymer glycol with organic diisocyanate, a hard segment is polymerized by a chain extender. If a low molecular-weight diol is used as the chain extender, the polyurethane polymer in which the hard segment is composed of urethane bonds is obtained, and if bifunctional amine is used, the polyurethane-urea polymer in which the hard segment is composed of urea bonds is obtained. The synthesis of the urethane intermediate-polymer may be carried out by the reaction in a non-active organic solvent such as amide type polar solvent. As a terminal stopper, monofunctional amine or monoalcohol may be used, each of which may be either mixed with the chain extender or used individually.

The polyurethane-urea elastic fiber may be obtainable, for example, through the following process: First, a high molecular-weight diol such as polyalkylene-ether diol is reacted with an organic diisocyanate such as 4,4'-diphenylmethane diisocyanate to synthesize an intermediate polymer having isocyanate at both ends. Subsequently, by extending a chain by a bifunctional amine such as ethylenediamine in an amide-type polar solvent such as dimethylacetamide, a solution of polyurethane-urea polymer is obtained. The adjustment of a molecular weight of the polymer is achieved by adding a predetermined amount of monofunctional amine used as the terminal stopper to bifunctional amine used as the chain extender. Various stabilizers or others are added to the polymer solution to be a spinning dope which is spun through a dry spinning machine to result in polyurethane elastomer fibers.

High molecular-weight diol includes various diols substantially composed of a linear homo- or copolymer such as polyester diol, polyether diol, polyesteramide diol, polyacryl diol, polythioester diol, polythioether diol, polycarbonate diol, mixtures thereof or copolymers thereof. Of them, a polyalkylene-ether glycol, which is not hydrolyzed by mildew when moistened, is preferable, such as polyoxyethylene glycol, polyoxypropylene glycol, polytetramethylene ether glycol, polyoxypentane-methylene glycol, copolymerized polyether glycol consisting of tetramethylene group and 2,2'-dimethylpropylene group, copolymerized polyether glycol consisting of tetramethylene group and 3-methyltetramethylene group or mixtures thereof. Particularly, polytetramethylene-ether glycol or copolymerized polyether glycol consisting of tetramethylene group and 2,2'-dimethylpropylene group is favorable because of its excellent elasticity. A number-average molecular weight of these high molecular-weight diols is preferably in a range from 500 to 10,000, more preferably from 1,000 to 3,000.

If the copolymerized polyether glycol consisting of tetramethylene group and 2,2'-dimethylpropylene group is used, a fabric is obtained which is soft in hand, high in elongation and stretch-recovery and low in modulus in comparison with one obtained from polytetramethylene-ether glycol.

Organic diisocyanate may be either of aliphatic, aliphacyclic or aromatic diisocyanate provided it is soluble in amide type polar solvent or it is of a liquid type. Examples thereof are 4,4'-diphenylmethane diisocyanate, 2,4'-diphenylmethane diisocyanate, 4,4'-diphenylether diisocyanate, toluene diisocyanate, 4,4'-dicyclohexylmethane diisocianate, 1,3- and 1,4-cyclohexylene diisocyanate, 1,6-hexamethylene diisocyanate, 3-(α-isocyanate-ethyl) phenyl isocyanate, trimethylene diisocyanate, isophorone diisocyanate, mixtures thereof and copolymers thereof. Of them, 4,4'-diphenylmethane diisocyanate is preferable.

Low molecular-weight diol used as a chain extender includes, for example, ethylene glycol, 1,2-propylene glycol, 1,3-propylene glycol, 1,3-butane diol, 1,4-butane diol, 1,5-pentane diol, 1,6-hexane diol, 2,2-dimethyl-1,3-propane diol, diethylene glycol, dipropylene glycol, 1,4-cyclohexane dimethanol and phenyldiethanol amine. Of them, 1,4-butane diol is preferable.

Bifunctional amine used as a chain extender includes, for example, ethylenediamine, 1,2-propylenediamine, 1,3-propylenediamine, 2-methyl-1,5-pentanediamine, triethylenediamine, m-xylylenediamine, piperazine, o-, m- and p-phenylenediamine, 1,3-diaminocyclohexane, 1,4-diaminocyclohexane, 1,6-hexamethylenediamine, N,N'-(methylene-4,1-phenylene)bis[2-(ethylamino)-urea] and mixtures thereof. Of them, ethylenediamine alone or a mixture of ethylenediamine with 5 to 40 mol % of one selected from a group of 1,2-propylenediamine, 1,3-diaminocyclohexane and 2-methyl-1, 5-pentadiamine is preferable.

Monofunctional amine used as a terminal stopper includes, for example, monoalkylamine such as isopropylamine, n-butylamine, t-butylamine or 2-ethylhexylamine, and dialkylamine such as diethylamine, dimethylamine, di-n-butylamine, di-t-butylamine, diisobutylamine, di-2-ethylhexylamine or diisopropylamine. These may be used alone, or mixed with each other.

Monoalcohol used as a terminal stopper includes, for example, methanol, ethanol, 2-propanol, 2-methyl-2-propanol, 1-butanol, 2-ethyl-1-hexanol and 3-methyl-1-butanol. These may be used alone or mixed with each other.

Amide type polar solvent includes, for example, dimethylacetamide, dimethylformamide and N-methylpyrrolidone.

Polyether-ester type synthetic fiber is one having hard segment including, for example, aromatic polyester such as polytetramethylene terephthalate, polytrimethlene terephthalate or polyethylene terephthalate and soft segment including, for example, aliphatic polyether glycol such as polytetramethylene glycol or polypropylene glycol, and aliphatic polyester glycol composed of adipic acid and 1,6-hexanediol or azelaic acid and 3-methyl-1, 5-pentanediol.

These synthetic fibers may be added with additives usually used, such as antioxidant, anti-yellowing agent, heat stabilizer or pigment. Also, oil may be applied to an outer surface of the fiber during the spinning.

Polyurethane type synthetic fiber thus spun may be imparted with oil including, for example, polydimethylsiloxane, polyester-modified silicone, polyether-modified silicone, amino-modified silicone, mineral oil, mineral powder such as silica, coroidal alumina or talc, powder of higher fatty acid metallic salt such as magnesium stearate or calcium stearate, and wax in a solid form at a normal temperature such as higher aliphatic carbonic acid, higher aliphatic alcohol, paraffin or polyethylene, which may be used alone or optionally mixed with each other if necessary.

The synthetic fiber according to the present invention is hardly knit or woven by itself, but may be mixedly used with a yarn of natural fiber such as cotton, silk or wool, polyamide fiber such as N6 or N66, polyester fiber such as polyethylene terephthalate, polytrimethylene terephthalate or polytetramethylene terephthalate, cation-dyeable polyester fiber, cuprammonium rayon, viscose rayon or acetate rayon to form a fabric. Or the synthetic fiber may be covered, entangled or twisted with these fibers to form a composite yarn which then is knit or woven to form a fabric.

A fabric using the synthetic fiber according to the present invention may be used for a swimsuit, a girdle, a grassiere, an intermediate wear, some stretch under wear, an elastic cord of socks, tights, panty hose, a waistband, a bodysuit, spats, stretch sportswear, stretch outerwear, a bandage, a supporter, medical wear, a stretch lining or a diaper.

The synthetic fiber according to the present invention excellent in moisture absorption also has an antistatic effect for preventing static electricity from generating. For example, when used as a material for panty hose, it is possible to avoid the discomfort that a skirt clings to the panty hose or static electricity is generated particularly in the winter season due to the friction with a car seat to give the passenger an electric shock.

The fabric composed of the synthetic fiber according to the present invention may be any of a weft-knit fabric, a warp-knit fabric or a woven fabric, in which the woven fabric includes a plain weave, a twill weave, a satin weave and derivatives thereof; the weft knit fabric includes a single plain knit, a double-mock rib, a smooth knit, a pique knit and derivatives thereof; and the warp knit fabric includes a tricot half, a tricot satin, derivatives thereof, a raschel power net, a raschel satin and a tulle, which are optionally selected in accordance with the use. An elongation of the knit fabric is preferably in a range from 30 to 300% in the direction necessitating the stretchability, while that of the woven fabric is preferably in a range from 5 to 100% in the direction necessitating the stretchability or in two directions orthogonal to each other.

The fabric using the synthetic fiber according to the present invention is suitably used for inner wear, sportswear and leg wear, in which the inner wear includes an undershirt, shorts, a girdle and a body fur; the sportswear includes spats and leotards; and the leg wear includes stockings, socks and tights; which are used for the purpose of personal adornment in addition to shielding a skin from outer air to keep a body warm, shaping the body form and preventing the body from vibrating.

A fiber size of the synthetic fiber according to the present invention may be optionally selected in accordance with fabric powers to be used, and generally in a range from 3 deniers (3.3 dtex) to 1080 deniers (1200 dtex). For example, in leg wear, the fiber size may be in a range from 3 deniers (3.3 dtex) to 100 deniers (110 dtex); in inner wear, from 10 deniers (11 dtex) to 1080 deniers (1200 dtex); and in sportswear, from 10 deniers (11 dtex) to 1080 deniers (1200 dtex). A yarn may be of any form including a bare yarn, a covered yarn in which a non-elastic yarn is covered with an elastic yarn, a twisted yarn of a non-elastic yarn and an elastic yarn, a core yarn obtained through a spinning process, an air-jet type composite yarn and a false-twisted yarn.

The synthetic fiber according to the present invention may be mixed with other materials in accordance with the use thereof, in which there is no limitation in kind, form and size thereof. For example, the material includes natural fiber represented by cotton, wool or rammie, regenerated fiber represented by viscose rayon or cuprammonium rayon, synthetic fiber represented by polyester or nylon and, further, elastic fiber having no moisture absorbability. A spun yarn mixedly spun with natural fiber represented by cotton or other fibers, an entangled mixed yarn (mixed with fibers having a different shrinkage or a high-strength), a twisted union yarn, a composite false-twisted yarn or a double-feed type air-jet textured yarn may be used.

A configuration of the fiber may be a filament form or a staple form. A size of the fiber may be uniform or changed in the lengthwise direction. The cross-sectional shape of the fiber may be circular, triangular, L-shaped, T-shaped, Y-shaped, W-shaped, oct-lobal, flat-shaped, dog bone-shaped, hollow or indefinite. In the inner wear, sportswear or leg wear use, a total size is preferably in a range from 5 deniers (5.6 dtex) to 225 deniers (250 dtex) and a single-filament size is in a range from 0.1 denier (0.11 dtex) to 5 deniers (5.6 dtex), but is not limited thereto provided they match with a fabric structure.

A warp knit fabric may be knit by using a conventional tricot machine or a raschel machine at a usual needle density in a range from 20 to 40/inch, in which the synthetic fiber according to the present invention may form knitting loops or be laid in a ground structure. The fabric is preferably of a knit structure in which the synthetic fiber is concealed within the fabric, since the synthetic fiber is inferior in chemical resistance and/or light-resistance in comparison with other fibers and thus liable to deteriorate the quality of goods in which the same is used if the former is used in a bare state, and since the synthetic fiber has a high frictional resistance and thus imparts the consumer with uncomfortable feel if it directly touches the consumer's skin. For example, the knit structure is preferably one in which the synthetic fiber is used in a back thread guide of a half-tricot structure or laid in via a back thread guide of a power net or satin structure. A basis weight of the knit fabric is preferably in a range from 20 to 300 g/m$^2$.

A weft knit fabric includes stockings, socks, tights, underwear, spats, leotard, shorts, girdles, body fur or the like, which are used for personal adornment, shielding a skin from outer air to keep a body warm, compensating for the deformation of a body shape or preventing a flesh from vibrating. The weft knit fabric may be knit by using a conventional circular knitting machine, a hosiery knitting machine and flat knitting machine at a usual needle density in a range from 5 to 40/inch. The synthetic fiber in a form of bare yarn may be knit to form knitting loops together with another fiber yarn, or may be converted to a composite yarn prior to be knit into the fabric. For example, the knit structure includes a bare plain stitch and a bare rib stitch structure. The composite yarn may be knit together with other fibers as a plied yarn similar to the bare yarn or may be knit alone to form a plain stitch, interlock stitch or half sack stitch. A basis weight is preferably in a range from 10 to 200 g/m$^2$.

As for a woven fabric, covering yarns are preferably used as both of warp and weft yarns to have a stretchability of 5% or more both in the warp and weft directions or solely in the weft direction. If the woven fabric used as shorts or camisoles for enjoying the coolness of a light-weight thin fabric and minimizing the influence to the outer wear, a plain weave is preferably employed wherein warp and weft elastic fibers are melt-bonded together so that the intersecting points between the warp and weft are inhibited when the clothing is worn. A basis weight is preferably in a range from 10 to 100 g/m$^2$.

Next, leg clothing will be described below which is one suitable use of the synthetic fiber according to the present invention, wherein the leg clothing includes panty hose, tights, over-knee stockings, high-socks, short-socks or the like.

Panty hose are thin stockings with a panty, consisting of a welt section including a waist rubber, a panty section including a hip portion, a leg section (including a foot portion and a heel portion) and a toe section.

Generally speaking, in panty hose, different yarns are used in the respective sections thereof such that the welt portion, panty section and toe section are often composed of a false-twist textured yarn, polyurethane type synthetic fiber or a covering yarn in which polyurethane type synthetic fiber is single- or double-covered with a false-twist textured yarn, and the toe section may be composed solely of a false-twist textured yarn. Panty hose are classified in accordance with kinds of yarn used in the leg section into a woolly type in which a false-twist textured yarn is used, a popular type in which 100% of a covering yarn of the polyurethane type synthetic fiber single- or double-covered with a raw yarn or a false-twisted textured yarn is used, a mixture knit type in which the covering yarn and the raw yarn or the false-twist textured yarn are mixedly knit, and a sheer type in which a twisted yarn of the raw yarn or false-twist textured yarn is used.

Tights are thick stockings with a panty, consisting of a welt section including a waist rubber, a panty section including a hip portion, a leg section and a toe section. Generally speaking, in the tights, the welt portion, panty section and toe section are often composed of a false-twist textured yarn, polyurethane type synthetic fiber or a covering yarn in which polyurethane type synthetic fiber is single- or double-covered with a false-twist textured yarn, and the leg section and the toe section may be composed of the same kind of yarn. Tights are classified in accordance with the kinds of yarn used in the leg section into a woolly type in which a false-twist textured yarn is used, a popular type in which 100% of a covering yarn of the polyurethane type synthetic fiber single- or double-covered with a raw yarn or a false-twisted textured yarn is used, a mixture knit type in which the covering yarn and the false-twist textured yarn are mixedly knit, and a sheer type in which a twisted yarn of the false-twist textured yarn is used.

Over-knee stockings, high-socks and short-socks are stockings with no panty, consisting of a top section in which a rubber yarn is to be inserted, a leg section and a toe section. One having the leg section reaching a thigh is the over-knee stockings, one reaching a lower portion of a knee is the high-socks and one reaching a calf is the short-socks. Generally speaking, the top section and the toe sections are often composed of a false-twist textured yarn, polyurethane type synthetic fiber or a covering yarn in which polyurethane type synthetic fiber is single- or double-covered with a false-twist textured yarn, and the leg section and the toe section may be composed of the same kind of yarn. These are classified in accordance with kinds of yarn used in the leg section into a woolly type in which a false-twist textured yarn is used, a popular type in which 100% of a covering yarn of the polyurethane type synthetic fiber single- or double-covered with a raw yarn or a false-twisted textured yarn is used, a mixture knit type in which the covering yarn and the raw yarn or the false-twist textured yarn are mixedly knit, and a sheer type in which a twisted yarn of the raw yarn or the false-twist textured yarn is used.

The false-twist texturing process may be carried out by using any of conventional devices including a pin type, a friction type, a nip belt type, an air-twisting type or others. Unless the purpose of the present invention is hindered, the polyurethane type synthetic fiber may be compositely mixed with other fibers such as cellulosic fiber through a covering method, an entangling method, a twisting method or a composite false-twisting method. A mixed-knitting with other fibers may be suitably used.

The polyurethane type synthetic fiber used for the leg clothing according to the present invention has a fiber size in a range from 3 deniers (3.3 dtex) to 100 deniers (110 dtex), preferably from 5 deniers (5.6 dtex) to 40 deniers (44 dtex). The raw yarn or the false-twist textured yarn of the polyurethane type synthetic fiber used for bare knitting has a fiber size in a range from 3 deniers (3.3 dtex) to 100 deniers (110 dtex), preferably from 5 deniers (5.6 dtex) to 70 deniers (78 dtex). If the fiber size is less than 3.3 dtex, a yarn strength falls to cause trouble in the knitting process, such as yarn breakage, or to deteriorate the stretchability and the durability of the resultant stockings. Contrarily, if exceeding 100 deniers (110 dtex), the binding force becomes excessively strong to impart the wearer with an oppressive feel, as well as to lose the transparency and increase the hard touch of the resultant stockings.

When the twisted yarn is used, a count of twist of the yarn may be optional irrespective of sizes of raw yarn or false-twisted yarn provided the yarn-collectiveness is maintained and the repulsive elasticity is improved in comparison with the raw yarn or the false-twisted yarn. The count of twists, however, is preferably in a range from 50 to 3,000 T/M, more preferably from 75 to 1,500 T/M, most preferably from 100 to 500 T/M. If the count of twist is less than 50 T/M, single-filaments are separated from each other to lose the transparency, or the single-filament catches to cause a so-called "tsure (Japanese)". Contrarily, if exceeding 3,000 T/M, kinks may occur during the knitting and partially knitted into loops of a fabric to significantly deteriorate the appearance. If the knit fabric becomes biased by the use of twisted yarns, S-twist yarn and Z-twist yarn may be alternately used for the knitting. When the leg section is knit with twisted yarns alone, a fiber size is in a range from 5 deniers (5.6 dtex) to 200 deniers (220 dtex), preferably from 10 deniers (11 dtex) to 100 deniers (110 dtex), more preferably from 15 deniers (17 dtex) to 75 deniers (84 dtex). If the fiber size is less than 5 deniers (5.6 dtex), the resultant product is liable to break due to lack of strength. Contrarily, if exceeding 200 deniers (220 dtex), the product becomes too thick and loses the transparency.

A conventional method may be used for producing panty hose. For example, a panty hose circular knitting machine can be used for this purpose, preferably having 300 to 600 needles and a cylinder diameter in a range from 7.62 to 12.7 cm.

A knit structure of the panty hoses is not limited, and includes a knit structure, a tuck structure, a welt structure, and combinations thereof. Patterns may be formed thereby.

Also, a loop size of the panty hoses is not limited. For example, a so-called fashioning may be adopted wherein the knitting operation is carried out while changing a loop density in the course direction which is a tuck-in depth of the needle, or a loop size of a so-called mating yarn may be changed, which is used in a mixedly knit stockings, such as a covering yarn, a straight yarn or a false-twist textured yarn.

A preset condition, a sewing condition, a dyeing condition, a finishing agent condition and a final set condition of the panty hose are not limited and may be optionally selected.

BEST MODES FOR CARRYING OUT THE INVENTION

The present invention will be described in more detail below with reference to the preferred examples but the scope of the present invention should not be restricted thereby. In this regard, measurements of the respective characteristics shown in the examples are as follows:

[A] Water Absorption Ratio of Water Absorption Resin

The water absorption resin is dried under a reduced pressure at 70° C. for 2 hours, and an absolutely dry weight thereof is measured. Then, the resin is immersed in water at 25° C. for 24 hours, and a water-contained weight is measured, from which the water absorption ratio is calculated by the following equation (1):

$$\text{Water absorption ratio (\% by weight)}=(\text{water-contained weight}-\text{absolutely dry weight})\times 100/\text{absolutely dry weight} \quad (1)$$

[B] Strength at Break, Elongation at Break and Strength-Retaining Ratio of Synthetic Fiber The synthetic fiber is left for 24 hours in an atmosphere at 20° C.×65% RH (atmosphere A) or at 30° C.×90% RH (atmosphere B), and tested in the respective atmosphere by a tensile tester UTM-111-100 available from K.K. TOYO BALDWIN. The measuring condition is that a test piece is set at an initial length of 50 mm and stretched at a rate of 500 mm/min until broken. A strength and an elongation (relative to the initial length: %) at break are measured. The strength-retaining ratio is calculated by the equation (2):

$$\text{Strength-retaining ratio (\%)}=(\text{Strength at break in atmosphere B/strength at break in atmosphere A})\times 100 \quad (2)$$

[C] Stretch Recovery of Synthetic Fiber

Measurement is carried out using the measuring instrument placed in atmosphere A. A test piece is stretched by 300% relative to the initial length (L0) and quickly returned to the initial length at the same rate, which cycle is repeated three times. In the third cycle, when a chuck gripping the test piece returns to the original position (corresponding to the initial length L0), a length L is measured at which a stress applied to the chuck becomes zero. That is, the stretch recovery ratio is calculated by the equation (2-1):

$$\text{Stretch recovery (wt \%)}=(4L_0-L)\times 100/3L_0 \quad (2\text{-}1)$$

The larger the stretch recovery, the better the recovery.

[D] Moisture Absorbing/Releasing Property of Synthetic Fiber

An absolutely dried weight of a predetermined amount of the synthetic fiber is measured (the drying condition is at 70° C. for 2 hours under a reduced pressure). After being left in the atmosphere A or B for 24 hours, a weight is measured again. Based on these measured values, the moisture absorption ratio in the atmosphere (A) is calculated by the equation (3), the moisture absorption ratio in the atmosphere (B) is calculated by the equation (4), and the moisture absorbing/releasing ability % is calculated by the equation (5):

$$\text{Moisture absorption ratio in atmosphere A (\% by weight)}=(\text{weight in atmosphere A}-\text{absolute weight})\times 100/\text{absolute weight} \quad (3)$$

$$\text{Moisture absorption ratio in atmosphere B (\% by weight)}=(\text{weight in atmosphere A}-\text{absolute weight})\times 100/\text{absolute weight} \quad (4)$$

$$\text{Moisture absorbing/releasing ability (\% by weight)}=\text{Moisture absorption ratio in atmosphere B}-\text{Moisture absorption ratio in atmosphere A} \quad (5)$$

The larger the moisture absorption ratio, the more the moisture being absorbed. The moisture absorbing/releasing ability is a driving force for obtaining comfort, and preferably is as large as possible.

[E] Color Fastness to Rubbing in a Wet Condition of Synthetic Fiber

A bare knit fabric is manufactured by a circular knitting machine CR-C Type (available from KOIKE SEISAKUSHO K.K.). The bare knit fabric of test fiber of 1.2 g and a bare knit fabric of polyamide (Leona 12 d/7 f available from ASAHI KASEI KOGYO K.K.) of 4.8 g are put into a stainless steel container and dyed with a non-sulfonic metallized dye (Irgalan Black BGL200 available from Bayer K.K.) of 4% owf in a dye bath of pH 4.0 (adjusted by acetic acid and ammonium sulfate) at 95° C. for 60 minutes. Thereafter, a fixing treatment with tannic acid (HIFIX SLA available from DAINIPPON SEIYAKU K.K.) and a soaping treatment are carried out, and then the knit fabric is rinsed with water and air-dried to result in a bare knit fabric for testing.

A color fastness to rubbing in a wet condition is estimated in accordance with JIS L 0849. The estimation is made in comparison with criteria of grade 1 to grade 5 in which grade 1 is the worst and grade 5 is the best. In this regard, between grades 4 to 5, the estimation is more finely made by a naked eye at a grade of 0.2.

[F] Preparation of Stockings and Estimation of Wear Comfort Thereof

Gray panty hose are prepared by using a conventional panty hose circuit knitting machine as described below. A welt section is mixedly knit (in a 1:1 tuck stitch structure) with the polyurethane type synthetic fiber of 140 deniers (155 dtex), a false-twist textured yarn (a) of nylon 66 of 56 dtex/17 f and a covering yarn (b) prepared by using a covering machine available from KATAOKA KIKAI K.K. by stretching a polyurethane type elastic fiber of 40 deniers (44 dtex) at a draw ratio of 3.0 which is single-covered with a false-twist textured yarn of nylon 66 of 30 deniers (33 dtex)/10 f twisted at 600 T/M in the S and Z directions, and a panty section and a toe section are mixedly knit with the false-twist textured yarn (a) and the covering yarn (b) in a plain stitch structure. Part of the panty section is knit in a 1:1 tuck stitch structure with the same yarns for the purpose of run-prevention. A leg section is knit solely with a covering yarn (c) prepared by using the covering machine available from KATAOKA KIKAI K.K. by stretching a polyurethane-urea type elastic fiber of 20 deniers (22 dtex) at a draw ratio of 3.0 which is single-covered with a false-twist textured yarn of nylon 66 of 12 deniers (13 dtex) /3 f twisted at 1800 T/M in the S and Z directions.

Next, after being preset by a conventional method, the gray panty hose thus obtained are sewn with a sewing thread (prepared by plying and twisting two false-twist textured yarns of nylon 66 of 30 deniers (33 dtex)/10 f). Then, the panty hose are dyed by a conventional method with acid dye into a brown which is a popular color, treated with a finishing agent and subjected to a final set to be a complete product.

(1) Wear Comfort

Ten subjects wearing the panty hose were subjected to light exercise in a room at a temperature of 30° C. and a relative humidity of 70% RH for 15 minutes. The light exercise is a walking at a speed of about 5 km/h. After completing the exercise, they are stationary in a breeze for 10 minutes, and then a hearing is conducted on the wear comfort including sensory items of "no stuffiness or clinginess is felt", "skin touch is good", "there is a dry feel", "stretchability is good", "supporting force is good" and "there is wear comfort". The respective sensory item is estimated by a five-step estimation system in which 5 is very good, 4 is good, 3 is indifferent, 2 is slightly no good, and 1 is no good. An average value of the ten subjects is adopted as an estimated value.

(2) Transparency of Leg Section

A sensory estimation is conducted by ten subjects wearing the panty hose to estimate the transparency of the leg section by a five-step estimation system in which 5 is very good, 4 is good, 3 is indifferent, 2 is slightly no good, and 1 is no good. An average value of the ten subjects is adopted as an estimated value.

(3) Appearance of Fabric in Leg Section

A sensory estimation is conducted by ten subjects wearing the panty hoses to estimate the appearance of a fabric of the leg section by a five-step estimation system in which 5 is very good, 4 is good, 3 is indifferent, 2 is slightly no good, and 1 is no good. An average value of the ten subjects is adopted as an estimated value.

(4) Moisture Absorbing/Releasing Property

Tests are conducted for simulating the movement in a hot summer environment and for simulating the movement in a cold winter environment.

Test conditions are as follows:

1) After sitting stationarily on a chair for 15 minutes in an environmental test room air-conditioned at a room temperature of 26° C. and a relative humidity of 60% RH, the subject wears the panty hose in the environmental test room. An amount of evaporated moisture generated from a thigh portion of the subject is measured by an Evaporimeter available from NISSHIN SANGYO K.K.

2) After sitting stationarily on a chair for 15 minutes in an environmental test room air-conditioned at a room temperature of 20° C. and a relative humidity of 65% RH, the subject transfers to another environmental test room air-conditioned at a room temperature of 30° C. and a relative humidity of 90% RH to simulate a hot summer environment and wears the panty hose. After sitting stationarily on a chair for 15 minutes, the subject returns again to the former environmental test room air-conditioned at a room temperature of 20° C. and a relative humidity of 65% RH, and sits stationarily on a chair for 15 minutes. This series of environmental conditions is a simulation of a daily life in a summer season wherein the environmental condition at a room temperature of 30° C. and a relative humidity of 90% RH is a simulation when the subject is stationary in the outdoor and the environmental condition at a room temperature of 20° C. and a relative humidity of 65% RH is a simulation when the subject transfers into an air-cooled house and is stationary there.

Also, according to this test, to simulate the actual clothing condition as closely as possible, the subject wears summer outer wear (a brassiere, shorts (cotton 100%), a semi-sleeve shirt (cotton 50%/polyester 50%), a semi-tight skirt (polyester 100% with no lining), socks (cotton 100%)).

A humidity inside the panty hose is measured every 30 seconds at a point on a thigh 10 cm above a patella by using a sensor, for measuring a temperature/humidity within clothing, available from SHIN-EI K.K.

3) After being stationary on a chair for 15 minutes in the environmental test room air-conditioned at a room temperature of 20° C. and a relative humidity of 65% RH, the subject transfers to another environmental test room air-conditioned at a room temperature of 10° C. and a relative humidity of 40% RH simulating a winter season and wears panty hose. After sitting stationarily on a chair for 15 minutes, the subject returns again to the former environmental test room air-conditioned at a room temperature of 20° C. and a relative humidity of 65% RH. This series of environmental conditions is a simulation of a daily life in a winter season wherein the environmental condition at a room temperature of 10° C. and a relative humidity of 40% RH is a simulation when the subject is stationary in the outdoor and the environmental condition at a room temperature of 20° C. and a relative humidity of 65% RH is a simulation when the subject transfers into a heated house and is stationary there.

Also, according to this test, to simulate the actual clothing condition as close as possible, the subject wears a winter outer wear (a brassiere, shorts (cotton 100%), a long sleeve shirt (cotton 50%/polyester 50%), a semi-tight skirt (polyester 100% with no lining), socks (cotton 100%) and a winter coat (a wadded jumper)).

A humidity inside the panty hoses is measured every 30 seconds at a point on a thigh 10 cm above a patella by using a sensor, for measuring a temperature/humidity within clothing, available from SHIN-EI K.K.

4) After sitting stationarily on a chair for 15 minutes in an environmental test room air-conditioned at a room temperature of 20° C. and a relative humidity of 65% RH, the subject transfers to another environmental test room air-conditioned at a room temperature of 30° C. and a relative humidity of 90% RH to simulate a summer hot environment and wears panty hose. After sitting stationarily on a chair for 10 minutes, the subject is subjected to treadmill walking at 4.5 km/hr for 15 minutes, after which the subject transfers to a further environmental test room air-conditioned at a room temperature of 26° C. and a relative humidity of 60% RH and stationarily sits on a chair for 15 minutes. This series of environmental conditions is a simulation of a daily life in a summer season wherein the environmental condition at a room temperature of 30° C. and a relative humidity of 90% RH is a simulation when the subject is walking outdoor and the environmental condition at a room temperature of 26° C. and a relative humidity of 60% RH is a simulation when the subject transfers into an air-cooled house and is stationary there.

Also, according to this test, to simulate the actual clothing condition as close as possible, the subject wears a summer outer wear (a brassiere, shorts (cotton 100%), a semi-sleeve shirt (cotton 50%/polyester 50%), a semi-tight skirt (polyester 100% with no lining) and socks (cotton 100%)). The humidity inside the panty hose is measured every 30 seconds at a point of a thigh 10 cm above a patella by using a sensor, for measuring a temperature/humidity within clothing, available from SHIN-EI K.K.

An amount of evaporated moisture generated from a thigh portion of the subject is measured by Evaporimeter available from NISSHIN SANGYO K.K.

EXAMPLE 1

An intermediate product polymer having a terminal isocyanate was obtained by reacting 10,000 parts by weight of polytetramethylene glycol having a number-average molecular weight of 1830 with 168.1 parts by weight of 4,4'-diphenylmethane diisocyanate in a nitrogen gas atmosphere at 65° C. while stirring the mixture for 1 hour. This intermediate product polymer was dissolved by dried dimethyl acetamide to obtain a solution having a concentration ion of the polymer by weight. Then, a dimethylacetamide solution containing 14 parts by weight of ethylenediamine and 2.7 parts by weight of diethylamine was added to the violently stirred intermediate polymer solution to obtain a polyurethane-urea polymer solution having a concentration of approximately 35%.

Urethane type water absorption resin having a number-average molecular weight (hereinafter referred to as Mn) of 60,000 and a water absorption ratio of 1,800% by weight composed of polyethylene glycol having an Mn of 7,000, 1,4-butanediol and 4,4'-diphenylmethane diisocyanate was added and mixed with the polyurethane-urea polymer at 25% by weight. This solution was mixed with an antioxidant, an anti-yellowing agent or others; that is, to the polyurethane polymer, 1.5% by weight of isopbutylene adduct of addition polymer of p-cresol and dicyclopentadien, 2.5% by weight of N,N-bis(2-hydroxyethyl)-t-butyleamine, 0.3% by weight of 2-(2'-hydroxy-3',5-dibenzyl-phenyl)-benzotriazol and 0.05% by weight of magnesium stearate are added to be a dry spinning dope. A solid content of the spinning dope was adjusted to be 35% by weight.

The spinning dope was fed to a dry spinning machine having a hot air temperature of 240° C. and taken up at 800 m/min to result in polyurethane-urea elastic fiber of 20 deniers/2 filaments.

Panty hose was prepared while using this elastic fiber in a leg section thereof and subjected to a wear test. Various physical properties of the elastic fiber and results of the wear test were shown in Table 1. The polyurethane-urea elastic fiber was excellent in elongation, stretch recovery and moisture absorbing/releasing property. The panty hose obtained from the elastic fiber were good in fitting and free from a stuffy or clingy feel.

That is, results of sensory estimation of discomfort, such as stuffiness or clinginess, and wear feel, such as skin touch, or fitting when wearing the panty hoses were shown in Table 1, from which it was found that the panty hose is excellent in moisture absorption, fabric appearance, transparency and wear comfort.

FIGS. 1 to 4 show results of simulation tests.

Figure 2:
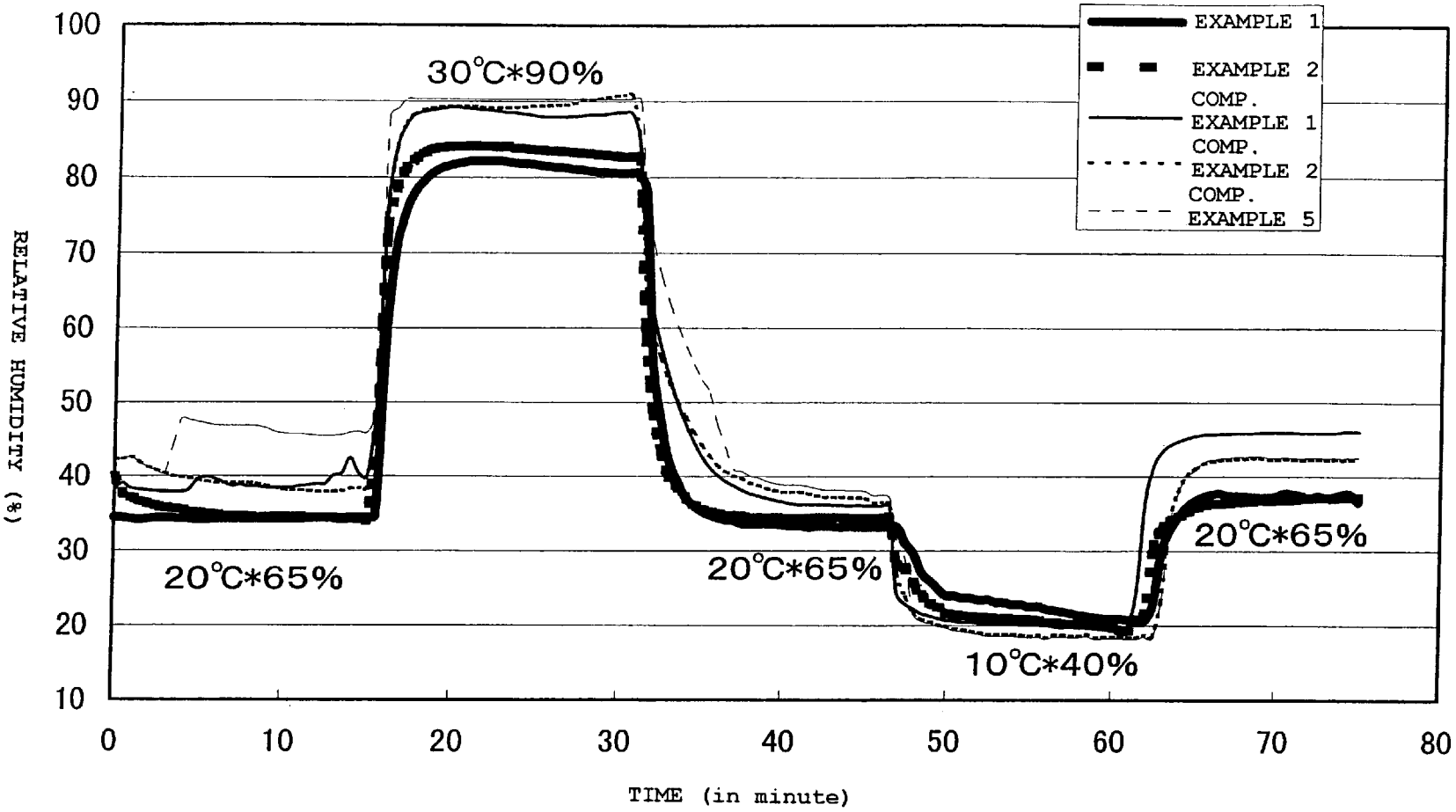
FIG. 2 is graphs showing a moisture absorbing/releasing capacity of panty hose compositely knit from fibers according to Examples and Comparative examples through tests carried out in environments simulating a hot summer season and a cold winter season.
Figure 3:
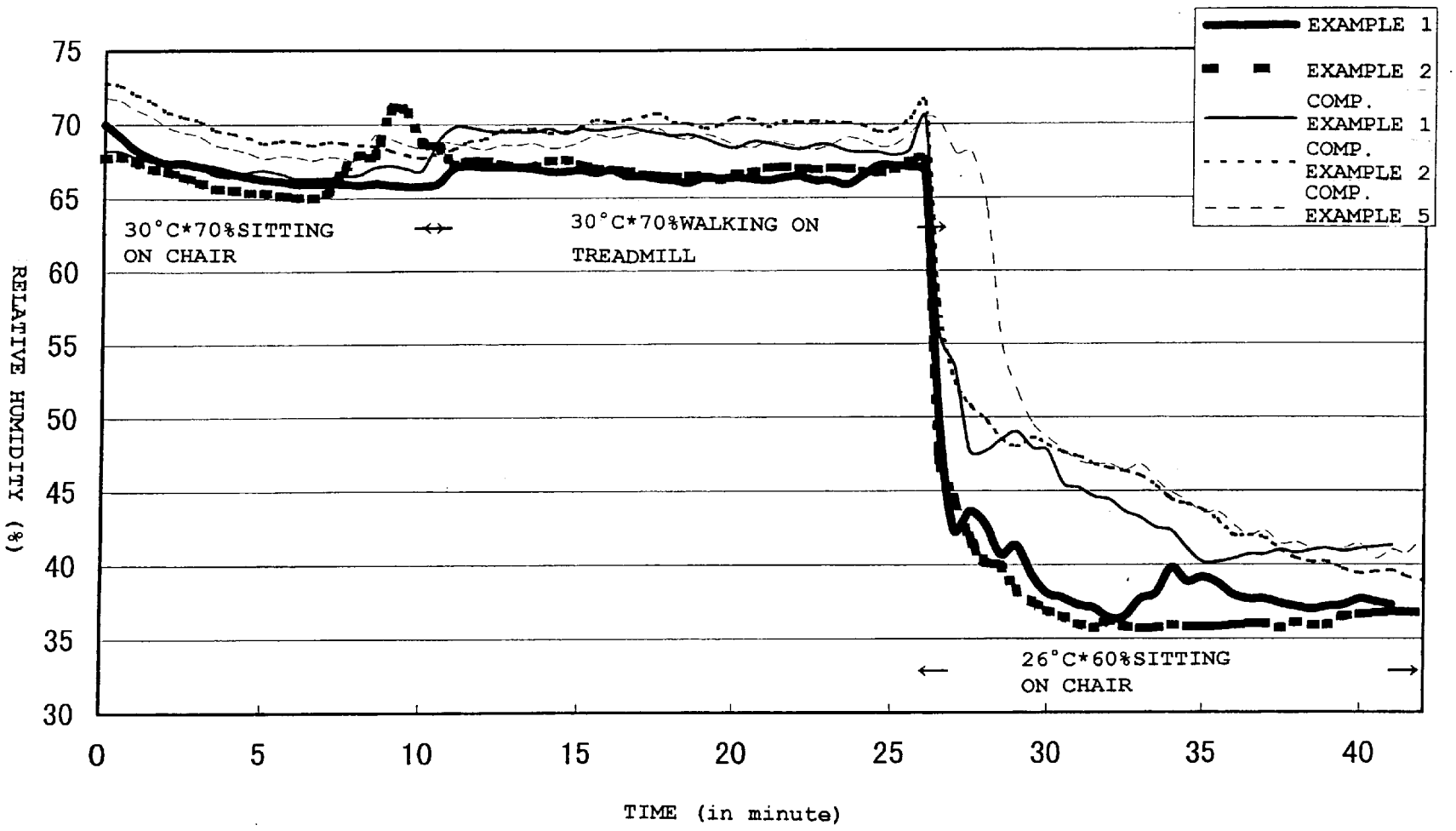
FIG. 3 is graphs comparatively showing a humidity in a clothing after the wearers putting on panty hose compositely knit from fibers according to Examples according to the present invention and Comparative examples are subjected to a running motion (using a treadmill)
Figure 4:
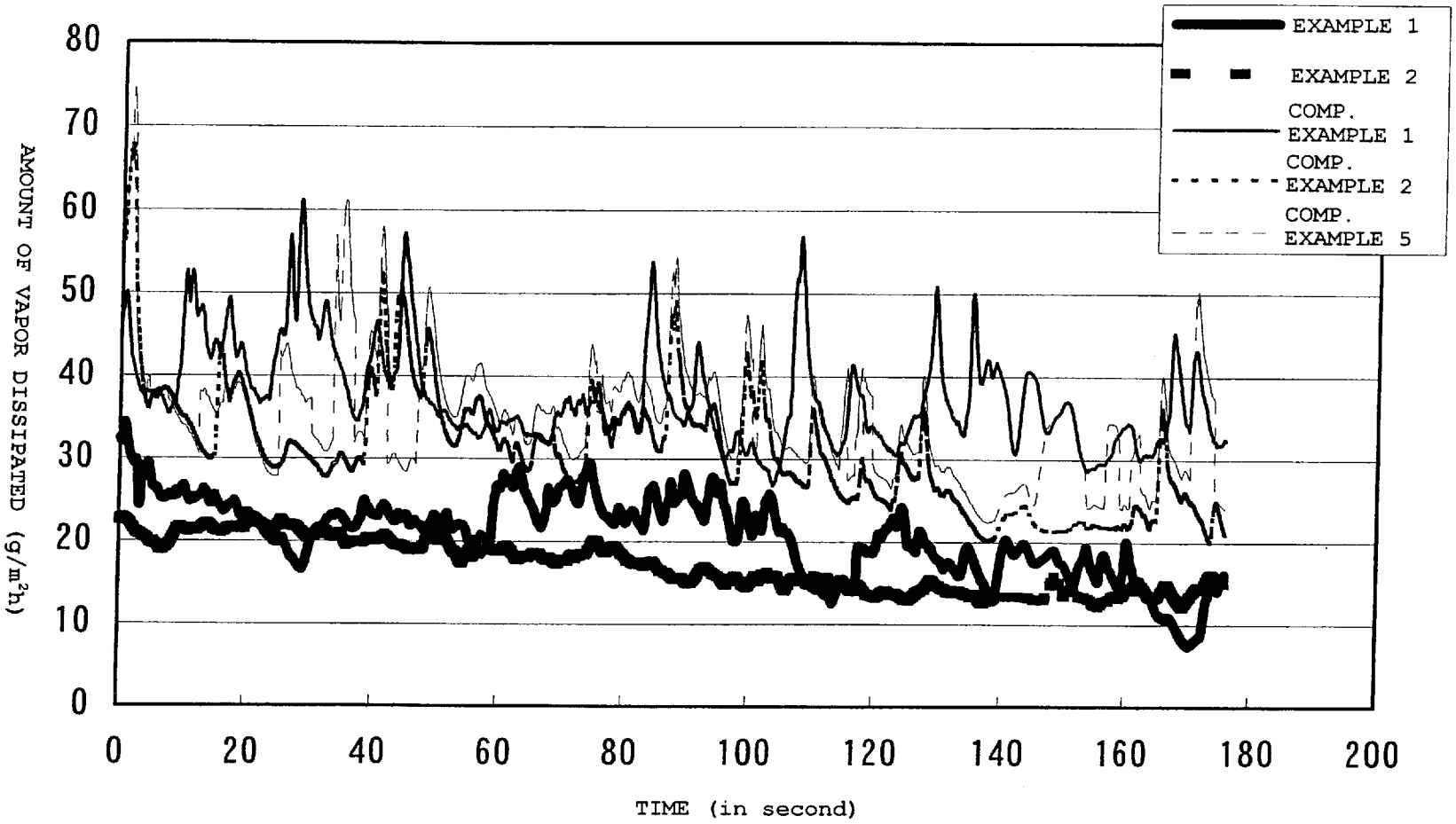
FIG. 4 is profiles comparatively showing a moisture evaporation in a clothing after the wearers putting on panty hose compositely knit from fibers according to Examples according to the present invention and Comparative examples are subjected to a running motion (using a treadmill) and then stationarily sit on a chair.

FIG. 1 shows an amount of evaporated water when stationarily sitting on a chair wherein the larger the amount of evaporated water, the better the moisture releasing operation. FIG. 2 shows a humidity in the panty hose at a point on a thigh when the subject transfers between different environments, wherein the lower the humidity, the less the stuffy and clingy feeling in a high temperature and high humidity environment of 30° C. and 90% RH. Also, FIG. 2 shows that, in a low temperature and low humidity environment of 10° C. and 40% RH, a moisture-retaining, a temperature-retaining effect is more obvious when the humidity is lower. FIG. 3 shows a humidity in the panty hoses at a point on a thigh wherein, after sitting stationarily on a chair in an environment of 30° C.×70% RH, the subject was subjected to a treadmill walking for 15 minutes in another environment of 30° C.×70% RH for 15 minutes, then transferred to still another environment of 26° C.×60% RH and stationarily sat on a chair. As is apparent from this figure, the lower the humidity during the treadmill walking in the environment of 30° C.×70% RH, the better the result; that is, the faster the loss of humidity after transferring to the environment of 26° C.×60% RH upon the completion of treadmill walking, the better the moisture releasing effect to lessen the stuffiness, clinginess or coldness. FIG. 4 shows an amount of evaporated water in an environment of 26° C.×60% RH after treadmill walking in an environment of 30° C.×70% RH. From FIG. 4, it will be understood that the lower the amount of evaporated water, the less the stuffy and clingy feel appears.

Results of the simulation tests will be described in more detail below. As apparent from FIG. 1, the amount of evaporated water in the environment of 26° C.×60% RH when the subject wearing the panty hose according to the present invention stationarily sat on a chair is more than in a case of conventional panty hose, and is always kept at a constant value. As apparent from FIG. 2, when the subject transferred from a high temperature and high humidity environment of 30° C.×90% RH to a standard environment of 20° C.×65% RH, a humidity in the panty hose in a thigh portion, after the transfer, abruptly descends, exhibiting the favorable moisture releasing effect, whereby the subject feels less stuffiness, clinginess and coldness. Then, when the subject transferred from the standard environment of 20° C.×65% RH to a low temperature and low humidity environment of 10C.×40% RH, humidity in the panty hoses in a thigh portion after the transferring gradually descends, exhibiting the favorable moisture retaining effect.

As is apparent from FIG. 3, when the subject transferred to an environment of 26° C.×60% RH after being subjected to treadmill walking at a speed of 4.5 km/hr in an environment of 30° C.×70% RH for 15 minutes, humidity in the panty hoses in a thigh portion abruptly descends, exhibiting the favorable moisture releasing effect, whereby the subject feels less stuffiness, clinginess and coldness. As is apparent from FIG. 4, when the subject transferred to an environment of 26° C.×60% RH and stationarily sat on a chair after being subjected to a treadmill walking at a speed of 4.5 km/hr in an environment of 30° C.×70% RH for 15 minutes, the amount of evaporated water is always maintained constant, indicating that the insensible perspiration is not left after the walking because of the excellent transpiration during the walking.

EXAMPLE 2

Polyurethane-urea elastic fiber and panty hose were prepared in the same manner as in Example 1, except that an amount of polyurethane type water absorption resin to be added to polyurethane-urea polymer is 11 parts by weight. Various physical properties of the elastic fiber thus obtained as well as wear comfort of the panty hoses were similarly shown in Table 1. As seen from Table 1, the wear comfort of panty hoses was good.

Results of the sensory estimation, that is, uncomfortableness such as stuffy or clingy feel due to the wear of panty hoses and wear feel such as skin touch or stretchability are shown in Table 1, from which it is apparent that the moisture absorption, fabric appearance, transparency and wear comfort are excellent.

Next, results of the simulation tests are shown in FIGS. 1 to 4. That is, as apparent from FIG. 1, the amount of evaporated water when the subject wearing the panty hoses according to the present invention stationarily sitting on a chair in the atmosphere of 26° C.×60% RH is more than in a case wherein the subject wears the conventional panty hoses, and is always maintained at a constant value. Also, as apparent from FIG. 2, when the subject transfers from the high temperature and high humidity environment of 30° C.×90% RH to the standard environment of 20° C.×65% RH, a humidity in the panty hoses in a thigh portion abruptly descends, exhibiting the favorable moisture releasing effect, whereby the subject feels less stuffiness, clinginess and coldness. Then, when transferring from the standard environment of 20° C.×65% RH to the low temperature and low humidity environment of 10° C.×40% RH, a humidity in the panty hoses in a thigh portion gradually descends, exhibiting a favorable moisture-retaining effect.

Also, as apparent from FIG. 3, when the subject was transferred to the environment of 26° C.×60% RH after being subjected to a treadmill walking in the environment of 30° C.×70% RH for 15 minutes, humidity in the panty hose in a thigh portion abruptly descends, exhibiting the favorable moisture releasing effect, whereby the subject feels less stuffiness, clinginess and coldness. As apparent from FIG. 4, when the subject was transferred to the environment of 26° C.×60% RH and sat stationarily on a chair after being subjected to a treadmill walking at a speed of 4.5 km/hr in the environment of 30° C.×70% RH for 15 minutes, the amount of evaporated water is always maintained constant, exhibiting that the insensible perspiration is not left after the walking because of the excellent transpiration during the walking.

Comparative Example 1

Polyurethane-urea elastic fiber and panty hose were prepared in the same manner as in Example 1, except that the urethane type water absorption resin is not added. Various physical properties of the elastic fiber thus obtained as well as wear feel of the panty hoses were similarly shown in Table 1. As seen from Table 1, stuffiness and clinginess are discernible whereby the estimation value is low.

Results of the sensory estimation such as uncomfortableness felt when the panty hoses has been worn, such as stuffiness or clinginess, and skin touch or stretchability are shown in Table 1. As is apparent therefrom, the moisture absorption, fabric appearance, transparency or wear comfort thereof is inferior.

Next, results of the simulation tests are shown in FIGS. 1 to 4. As is apparent from FIG. 1, the amount of evaporated water when the subject stationarily sits on a chair in the environment of 26° C.×60% RH is less and not maintained always constant. As apparent from FIG. 2. When the subject transfers from a high temperature and high humidity environment of 30° C.×90% RH to the standard environment of 20° C.×65% RH, a humidity in the panty hoses in a thigh portion after the transferring does not abruptly descend, exhibiting unfavorable moisture releasing effect, whereby the subject largely feels stuffiness, clinginess and coldness. Then when the subject transferred from the standard environment of 20° C.×65% RH to the low temperature and low humidity environment of 10° C.×40% RH, a humidity in the panty hoses in a thigh portion after the transferring abruptly descends, exhibiting unfavorable moisture retaining effect.

As apparent from FIG. 3, when the subject transferred to the environment of 26° C.×60% RH after being subjected to a treadmill walking at a speed of 4.5 m/hr for 15 minutes in the environment of 30° C.×70% RH, humidity in the panty hose in a thigh portion does not abruptly descend, exhibiting unfavorable moisture releasing effect, whereby the subject largely feels stuffiness, clinginess and coldness. As apparent from FIG. 4, when the subject transferred to the environment of 26° C.×60% RH and stationarily sat on a chair after being subjected to a treadmill walking at a speed of 4.5 km/hr for 15 minutes in the environment of 30° C.×70% RH, water was not always constantly evaporated but an amount of the evaporated water fluctuated with time. Also, since the transpiration during the walking is unfavorable, the insensible perspiration is left after the walking to increase the amount of evaporated water.

TABLE 1

| | Example 1 | Example 2 | Comparative example 1 | Comparative example 2 | Comparative example 5 |
|---|---|---|---|---|---|
| Elongation at break (%) | 530 | 570 | 620 | 610 | — |
| Stretch recovery (%) | 84 | 90 | 90 | 90 | — |
| Moisture absorption ratio in atmosphere A (% by weight) | 1.5 | 1.9 | 1.0 | 1.1 | 17.5 |
| Moisture absorption ratio in atmosphere B (% by weight) | 11.8 | 6.9 | 1.5 | 4.0 | 36.7 |
| Difference in moisture absorption ratio between atmospheres A and B (% by weight) | 10.3 | 5.0 | 0.5 | 2.9 | 19.2 |
| Aesthetical point | | | | | |
| Fabric appearance | 4.5 | 4.4 | 2.2 | 2.7 | 1.9 |
| Transparency | 4.7 | 4.7 | 2.1 | 2.2 | 1.8 |
| Wearing comfort | | | | | |
| No stuffiness or clinginess is felt | 4.8 | 4.7 | 1.5 | 2.4 | 1.8 |
| Skin touch is good | 4.6 | 4.7 | 1.6 | 2.1 | 2.0 |
| There is a dry feeling | 4.9 | 4.7 | 1.0 | 2.0 | 1.0 |
| Stretchability is good | 4.3 | 4.3 | 3.4 | 3.4 | 1.7 |
| Supporting force is good | 4.6 | 4.5 | 3.1 | 3.1 | 1.4 |
| There is a wearing comfort | 4.8 | 4.8 | 1.2 | 2.0 | 1.1 |

EXAMPLES 3 TO 12

As shown in Table 2, urethane type water absorption resins having various water absorption ratios, urea compounds and a known additive (polyurethane compounds described in Example 4 of Kokai No. 7-316922) were added to the polyurethane-urea compound of Example 1, and polyurethane-urea polymeric fibers were obtained in the same manner as in Example 1. All of the fibers had a proper moisture absorbing/releasing property, as well as excellent strength-retaining ratio and color fastness to rubbing under the moistened state.

Comparative Example 2

Polyurethane-urea elastic fiber was obtained in the same manner as in Example 1 except that an amount of urethane type water absorption resin in Example 3 is reduced to 2%. Since the amount to be added was too little, the moisture absorbing/releasing property was unsatisfactory.

That is, results of the sensory estimation when the subject wears the panty hose, such as discomfortableness including stuffiness and clinginess, skin touch or stretchability are shown in Table 1, from which it is apparent that the panty hose are inferior in moisture absorption, fabric appearance, transparency and wear comfort.

Results of the simulation tests are shown in FIGS. 1 to 4. As apparent from FIG. 1, when the subject stationarily sat on a chair in the environment of 26° C.×60% RH, an amount of evaporated water is less and not always maintained constant. As apparent from FIG. 2, when the subject transferred from the high temperature and high humidity environment of 30° C.×90% RH to the standard environment of 20° C.×65% RH, a humidity in the panty hoses in a thigh portion after the transferring does not abruptly descend, exhibiting unfavorable moisture releasing effect, whereby the subject largely feels stuffiness, clinginess and coldness. Then, when the subject transferred from the standard environment of 20° C.×65% RH to the low temperature and low humidity environment of 10° C.×40% RH, a humidity in the panty hoses in a thigh portion after the transferring abruptly descends, exhibiting unfavorable moisture retaining effect.

Also, as apparent from FIG. 3, when the subject transferred to an environment of 26° C.×60% RH after being subjected to treadmill walking at a speed of 4.5 km/hr in an environment of 30° C.×70% RH for 15 minutes, a humidity in the panty hoses in a thigh portion does not abruptly descend, exhibiting an unfavorable moisture releasing effect, whereby the subject largely feels stuffiness, clinginess and coldness. As is apparent from FIG. 4, when the subject transferred to the environment of 26° C.×60% RH and stationarily sat on a chair after being subjected to treadmill walking at a speed of 4.5 km/hr for 15 minutes in the environment of 30° C.×70% RH, water was not always constantly evaporated but an amount of the evaporated water fluctuated with time. Also, since the transpiration during the walking is unfavorable, the insensible perspiration is left after the walking to increase the amount of evaporated water.

Comparative Example 3

Polyurethane-urea elastic fiber was obtained in the same manner as in Example 1 except that an amount of urethane type water absorption resin in Example 8 is increased to 50%. Since the amount to be added was too much, the strength largely falls when the moisture is absorbed and the color fastness to rubbing in a wet condition is also inferior. Further, the product has a large moisture absorption ratio to result in a clingy feel.

Comparative Example 4

In the same manner as in Example 1, polyurethane-urea elastic fiber was obtained by using urethane type water absorption resin obtained from high molecular-weight diol composed of polyethylene glycol having Mn of 7,000 and polytetramethylene glycol having Mn of 3000 blended at a ratio of 2:8, instead of the high molecular-weight diol used in Example 1. The moisture absorbing/releasing property of this fiber was unsatisfactory.

Comparative Example 5

In the same manner as in Example 1, polyurethane-urea elastic fiber was obtained by adding magnesium chloride of 8% by weight disclosed in Example 1 of Kokai No. 5-271432, instead of the urethane type water absorption resin of Example 1.

Results of the sensory estimation of discomfortableness such as stuffiness or clinginess and wear feel such as skin touch or fitting when wearing the panty hoses were shown in Table 1, from which it was found that the panty hose is inferior in moisture absorption, fabric appearance, transparency and wear comfort.

Results of the simulation tests were shown in FIGS. 1 to 4. As apparent from FIG. 1, an amount of evaporated water when the subject stationarily sat on a chair in the environment of 26° C.×60% RH is less and not always maintained constant. As is apparent from FIG. 2, when the subject transferred from the high temperature and high humidity environment of 30° C.×90% RH to the standard environment of 20° C.×65% RH, humidity in the panty hose in a thigh portion after the transferring does not abruptly descend, exhibiting an unfavorable moisture releasing effect, whereby the subject largely feels stuffiness, clinginess and coldness. Then when the subject transferred from the standard environment of 20° C.×65% RH to the low temperature and low humidity environment of 10C.×40% RH, humidity in the panty hose in a thigh portion after the transferring abruptly descends, exhibiting an unfavorable moisture retaining effect.

As is apparent from FIG. 3, when the subject transferred to the environment of 26° C.×60% RH after being subjected to treadmill walking at a speed of 4.5 m/hr for 15 minutes in the environment of 30° C.×70% RH, a humidity in the panty hoses in a thigh portion does not abruptly descend, exhibiting unfavorable moisture releasing effect, whereby the subject largely feels stuffiness, clinginess and coldness. As is apparent from FIG. 4, when the subject transferred to the environment of 26° C.×60% RH and stationarily sat on a chair after being subjected to a treadmill walking at a speed of 4.5 km/hr for 15 minutes in the environment of 30° C.×70% RH, water was not always constantly evaporated but an amount of the evaporated water fluctuated with time. Also, since the transpiration during the walking is unfavorable, the insensible perspiration is left after the walking to increase the amount of evaporated water.

Comparative Example 6

Polyurethane resin having a water absorption ratio of 1600% by weight was obtained by reacting 1 mol of polyethylene glycol having a number-average molecular weight of 6000, 2 mol of 4,4'-diphenylmethane diisocyanate and 0.25 mol of 1,4-butanediol with each other. This resin was molten and extruded from a nozzle to obtain polyurethane type synthetic monofilament fiber of 20 deniers. The fibers obtained from Comparative examples 5 and 6 had a large moisture absorption ratio and was clingy. Also, the strength and the color fastness to rubbing in a wet condition were largely deteriorated in a wet condition.

Table 3 shows a strength, strength-retaining ratio, moisture absorbing/releasing property and color fastness to rubbing in a wet condition in the atmospheres A and B, respectively, in Examples 3 to 12 and Comparative examples 1 to 6.

TABLE 2

| | Water-absorption resin | | | | | | Urea compound | | | | | |
|---|---|---|---|---|---|---|---|---|---|---|---|---|
| | High molecular-weight diol (a) | Organic diiso-cyanate (b) | Low molecular-weight diol or bifunctional amine (c) | Number-average molecular-weight of water-absorption resin | Water-absorption ratio (% by weight) | Amount added to poly-urethane-urea polymer (% by weight) | Nitrogen-contained compound (A) | Organic diiso-cyanate (B) | Compound (C) | Number-average molecular-weight of urea compound | Amount added to poly-urethane-urea polymer (% by weight) | Known additive |
| Example 3 | PEG (Mn 7000) | HMDI | BD | 70000 | 1800 | 15 | — | — | — | — | — | — |
| Example 4 | PEG (Mn 7000) | HMDI | — | 70000 | 2200 | 15 | — | — | — | — | — | — |
| Example 5 | PEG (Mn 7000) | HMDI | BD | 70000 | 1800 | 15 | AEP | IPDI | PI | 800 | 4 | — |
| Example 6 | PEG (Mn 7000) | HMDI | BD | 70000 | 1800 | 15 | AEP | IPDI | PI | 800 | 4 | 4% by weight of polyurethane polymer disclosed in Example 4 of Kokai No. 7-316922 |
| Example 7 | PEG (Mn 18000) | MDI | BD | 120000 | 900 | 30 | — | — | — | — | — | — |
| Example 8 | PEG (Mn 18000) | HMDI | — | 120000 | 2400 | 30 | — | — | — | — | — | — |
| Example 9 | PEG (Mn 18000) | HMDI | — | 120000 | 2400 | 30 | AEP | MDI | TBA | 800 | 8 | 2% by weight of polyurethane polymer disclosed in Example 4 of Kokai No. 7-316922 |
| Example 10 | PEG (Mn 7000) PPG (Mn 7000) [Ratio by weight 6/4] | HMDI | BD | 70000 | 1000 | 20 | — | — | — | — | — | — |
| Example 11 | PEPG (Mn 7000) [EO/PO ratio by weight 8/2] | HMDI | — | 70000 | 1600 | 20 | — | — | — | — | — | — |
| Example 12 | PEG (Mn 6000) | HMDI | EDA | 70000 | 1800 | 15 | — | — | — | — | — | — |
| Comparative example 1 | — | — | — | — | — | — | — | — | — | — | — | — |
| Comparative example 2 | PEG (Mn 7000) | HMDI | BD | 70000 | 1800 | 2 | — | — | — | — | — | — |
| Comparative example 3 | PEG (Mn 18000) | HMDI | — | 120000 | 2400 | 50 | — | — | — | — | — | — |
| Comparative example 4 | PEG (Mn 7000)/ PTMG (Mn 3000) [Ratio by weight 2/8] | HMDI | BD | 70000 | 300 | 20 | — | — | — | — | — | — |
| Comparative example 5 | — | — | — | — | — | — | — | — | — | — | — | 8% by weight of magnesium chloride |

TABLE 2-continued

| | Water-absorption resin | | | | | | Urea compound | | | | | |
|---|---|---|---|---|---|---|---|---|---|---|---|---|
| | High molecular-weight diol (a) | Organic diiso-cyanate (b) | Low molecular-weight diol or bifunctional amine (c) | Number-average molecular-weight of water-absorption resin | Water-absorption ratio (% by weight) | Amount added to poly-urethane-urea polymer (% by weight) | Nitrogen-contained compound (A) | Organic diiso-cyanate (B) | Compound (C) | Number-average molecular-weight of urea compound | Amount added to poly-urethane-urea polymer (% by weight) | Known additive |
| | | | | | | | | | | | | disclosed in Example 1 of Kokai No. 5-271432 |
| Comparative example 6 | Polyurethane type synthetic fiber obtained by melt-spinning polyurethane resin composed of PEG (Mn 6000), MDI and BD (molar ratio = 1:2:0.25), having a water-absorption ratio of 1600% by weight. | | | | | | | | | | | |

Note: abbreviations in Table 2 are as follows:
PTMG polytetramethyleneether glycol
PEG polyethylene glycol
PPG polypropylene glycol
EO ethylene unit
PO propylene unit
PEPG polyalkylene ether glycol composed of ethylene unit and propylene unit copolymerized with each other
MDI 4,4'-diphenylmethane diisocyanate
HMDI 4,4'-dicyclohexyl diisocyanate
IPDI isophorone diisocyanate
PI phenylisocyanate
AEP N-(2-aminoethyl)piperazine
TBA t-butylamine
BD 1,4'-butanediol
EG ethylene glicol
EDA ethylenediamine

TABLE 3

| | Strength at break and strength-retaining ratio | | | Moisture absorbing/releasing property | | | | | |
|---|---|---|---|---|---|---|---|---|---|
| | Strength at break in atmosphere A (g) | Strength at break in atmosphere B (g) | Strength-retaining ratio obtained from equation (1) (%) | Moisture-absorption ratio in atmosphere A (% by weight) | Moisture-absorption ratio in atmosphere B (% by weight) | Difference in moisture-absorption ratio between* atmospheres A and B (% by weight) | color fastness to rubbing in wet condition (grade) | Elongation (%) | Stretch-recovery (%) |
| Example 3 | 33.6 | 31.6 | 94 | 2.0 | 11.0 | 9.0 | 4.4 | 560 | 89 |
| Example 4 | 33.2 | 31.9 | 96 | 2.2 | 14.2 | 12.0 | 4.6 | 580 | 90 |
| Example 5 | 31.6 | 30.7 | 97 | 1.8 | 10.3 | 8.5 | 5 | 550 | 87 |
| Example 6 | 31.6 | 30.4 | 98 | 2.7 | 16.6 | 13.9 | 5 | 530 | 82 |
| Example 7 | 30.4 | 28.9 | 95 | 2.5 | 11.9 | 9.4 | 4.4 | 480 | 80 |
| Example 8 | 30.0 | 27.3 | 91 | 3.6 | 26.3 | 22.7 | 4 | 490 | 81 |
| Example 9 | 29.5 | 28.0 | 95 | 3.4 | 24.8 | 21.4 | 5 | 450 | 76 |
| Example 10 | 32.2 | 31.6 | 98 | 1.6 | 8.1 | 6.5 | 4.6 | 470 | 79 |
| Example 11 | 32.4 | 30.8 | 95 | 1.7 | 12.9 | 11.2 | 4.4 | 460 | 80 |
| Example 12 | 32.8 | 30.2 | 92 | 2.1 | 10.8 | 8.7 | 4.2 | 572 | 86 |
| Comparative example 1 | 34.7 | 34.4 | 99 | 1.0 | 1.5 | 0.5 | 3 | 620 | 90 |
| Comparative example 2 | 34.3 | 34.0 | 99 | 1.1 | 4.0 | 2.9 | 3 | 610 | 90 |
| Comparative example 3 | 20.4 | 11.4 | 56 | 6.3 | 45.6 | 39.3 | 2 | 290 | 60 |
| Comparative example 4 | 27.0 | 27.0 | 98 | 2.1 | 5.2 | 3.1 | 3 | 440 | 72 |
| Comparative example 5 | 21.5 | 13.3 | 62 | 17.5 | 36.7 | 19.2 | 1 | 330 | 62 |
| Comparative example 6 | 23.7 | 10.0 | 42 | 27.0 | 98.0 | 71.0 | 2 | 350 | 57 |

EXAMPLE 13

The spinning dope of the polyurethane-urea polymer obtained in Example 3 was fed to a dry spinning machine at a hot air temperature of 240° C. and taken up at a winding speed of 800 m/min to result in polyurethane-urea elastic fiber of 40 deniers (44 dtex)/4 filaments. A bare plain stitch knit fabric was prepared from the polyurethane-urea elastic fiber of 40 deniers (44 dtex)/4 filaments thus obtained and nylon fiber of 70 deniers (78 dtex)/68 filaments by using a circular knitting machine under the following condition, and shorts were formed therefrom. The estimation was made on the shorts in the same manner as in Example 1, results of which are shown in Table 4. The shorts were excellent in wear comfort, that is, they are free from stuffiness and clinginess.

Condition for knitting bare plain stitch knit fabric:

Knitting machine: manufactured by Okuma Morat K.K.; 24 gauge/in; 11 rpm

Mixture ratio of polyurethane-urea elastic fiber: 18.6%

Feeding rate of nylon fiber: 37 m/min

Draft ratio of polyurethane-urea elastic fiber: 2.5

The obtained bare plain stitch knit fabric was dyed under the following condition:

Scouring: SCOUROL FC-250 (available from KAO K.K.; a trade name), 2 g/L; 60° C.×20 minutes Preset: 180° C.×45 seconds Dyeing: off-white; rate of temperature rise: 2° C./minute, 90° C.×30 minutes Final set: 170° C.×45 seconds; density: 75 course/in and 48 wale/in

EXAMPLE 14

The spinning dope of polyurethane-urea polymer obtained in Example 3 was fed to a dry spinning machine at a hot air temperature of 240° C. and taken up at a winding speed of 500 m/min to result in polyurethane-urea elastic fiber of 280 deniers (310 dtex)/36 filaments. A raschel knit fabric was prepared from the polyurethane-urea elastic fiber of 280 deniers (310 dtex) thus obtained and nylon fiber of 50 deniers (56 dtex)/17 filaments by using a raschel knitting machine under the following condition, and a girdle was formed therefrom. The estimation was made on the girdle in the same manner as in Example 1, results of which are shown in Table 4. The girdle was excellent in wear comfort, that is, it was free from stuffiness and clinginess.

Condition for knitting raschel knit fabric:

Knitting machine: raschel knitting machine manufactured by KARL MEYER K.K.; 28 gauge/in Structure: 6-course satin net
front 10/01/10/12/21/12
back 00/22/11/33/11/22

Runner length
front 113.5 cm
back 10.0 cm

The polyurethane-urea elastic fiber was warped while stretched at 100%. The above condition is a machine setting condition.

On-machine course: 90 courses/in

Mixture ratio of polyurethane-urea elastic fiber: 20%

The raschel knit fabric thus obtained was dyed under the following condition:

Scouring: SCOUROL FC-250 (available from KAO K.K.; a trade name), 2 g/L; 60° C.×20 minutes Preset: 190° C.×45 seconds Dyeing: off-white; rate of temperature rise: 2° C./minute, 90° C.×30 minutes Final set: 170° C.×45 seconds; density: 60 course/in and 40 wale/in

EXAMPLE 15

The spinning dope of polyurethane-urea polymer obtained in Example 3 was spun in the same manner as in Example 1 to result in polyurethane-urea elastic fiber of 40 deniers (44 dtex)/4 filaments. A raschel knit fabric was prepared from the polyurethane-urea elastic fiber of 40 deniers (44 dtex) thus obtained and nylon fiber of 50 deniers (56 dtex)/17 filaments by using a tricot knitting machine under the following condition, and spats were formed therefrom. The estimation was made on the spats in the same manner as in Example 1, results of which are shown in Table 4. The spats were excellent in wear comfort, that is, they are free from stuffiness and clinginess.

Condition for knitting tricot knit fabric:

Knitting machine: tricot knitting machine manufactured by KARL MEYER K.K.; 28 gauge/in Structure: half tricot
front 23/10
back 10/12

Runner length
front 160 cm
back 80 cm

The polyurethane-urea elastic fiber was warped while stretched at 100%. The above condition is a machine setting condition.

On-machine course: 90 courses/in

Mixture ratio of polyurethane-urea elastic fiber: 20.5%

The tricot knit fabric thus obtained was dyed under the following condition:

Scouring: SCOUROL FC-250 (available from KAO K.K.; a trade name), 2g/L; 60° C.×20 minutes Preset: 190° C.×45seconds Dyeing:

| | |
|---|---|
| black; Irgalan Black BGL | 2.7% owf |
| ammonium sulfate | 3.0% owf |
| acetic acid | 0.2% owf |
| Rate of temperature rise | 2° C./min, 80° C. × 30° C. |

Fixing Treatment

HIFIX SLA (available from DAINIPPON SEIYAKU K.K.) 3% owf rate of temperature rise 2° C./min, 80° C.×20 minutes Final set: 170° C.×45 seconds; density: 114 course/in and 75 wale/in

EXAMPLE 16

The polyurethane elastic fiber of 20 deniers (22 dtex)/2 filaments obtained from Example 6 was covered with nylon 66 fiber of 20 deniers (22 dtex)/24 filaments at a covering draft ratio of 3.0 to result in a covering yarn of 1000 T/M. A stretch fabric was woven by using the covering yarn as a weft and a yarn of 20 deniers (22 dtex)/7 filaments as a warp under the following condition, from which fabric are prepared shorts. The estimation was made on the shorts in the same manner as in Example 1, results of which are shown in Table 4. The shorts were excellent in wear comfort, that is, they are free from stuffiness and clinginess.

Loom: a rapier loom manufactured by TSUDAKOMA K.K.

Reed drawing-in width: 204 cm

Number of weft insertion: 110 picks/in

Total number of warp yarns: 14500

Gray fabric density: warp density 200/in; weft density 110/in

Mixture ratio of polyurethane-urea elastic fiber: 10.6%

The resultant fabric was dyed under the following condition:

Scouring: SCOUROL FC-250 (available from KAO K.K.; a trade name)
2g/L, 60° C.×20 minutes Preset: 200° C.×45 seconds Dyeing: off-white, a rate of temperature rise 2° C./min, 130° C.×30 minutes Final set: 170° C.×45 seconds Finished density: warp 330/in and weft 120/in

EXAMPLE 17

The polyurethane elastic fiber of 20 deniers (22 dtex)/2 filaments obtained from Example 6 was covered with nylon 66 fiber of 20 deniers (22 dtex)/24 filaments at a covering draft ratio of 3.0 to result in a covering yarn of 1000 T/M. A stretch fabric was woven by using the covering yarn as both of weft and warp under the following condition, from which fabric are prepared shorts. The estimation was made on the shorts in the same manner as in Example 1, results of which are shown in Table 4. The shorts were excellent in wear comfort, that is, they are free from stuffiness and clinginess.

Loom: a rapier loom manufactured by TSUDAKOMA K.K.

Reed drawing-in width: 204 cm

Number of weft insertion: 110 picks/in

Total number of warp yarns: 8800

Gray fabric density: warp density 120/in; weft density 110/in

Mixture ratio of polyurethane-urea elastic fiber: 25.0%

The resultant fabric was dyed under the following condition:

Scouring: SCOUROL FC-250 (available from KAO K.K.; a trade name)
2g/L, 60° C.×20 minutes Preset: 200° C.×45 seconds Dyeing: off-white, a rate of temperature rise 2° C./min, 130° C.×30 minutes Final set: 170° C.×45 seconds Finished density: warp 170/in and weft 145/in Comparative Example 9

A bare plain stitch knit fabric was prepared from the polyurethane type elastic fiber (available from ASAHI KASEI K.K.; a trade name Roica SC Type) of 40 deniers (44 dtex) and nylon fiber of 70 deniers (78 dtex)/68 filaments in the same manner as in Example 13, and shorts were formed therefrom. The estimation was made on the shorts in the same manner as in Example 1, results of which are shown in Table 4. The shorts were unsatisfactory in stuffiness and clinginess.

Comparative Example 10

A raschel knit fabric was prepared from the polyurethane type elastic fiber (available from ASAHI KASEI K.K.; a trade name Roica SC Type) of 280 deniers (310 dtex) and nylon fiber of 50 deniers (56 dtex)/17 filaments in the same manner as in Example 14, and a girdle was formed therefrom. The estimation was made on the girdle in the same manner as in Example 1, results of which are shown in Table 4. The girdle was unsatisfactory in stuffiness and clinginess.

Comparative Example 11

A two-way tricot was prepared from the polyurethane type elastic fiber (available from ASAHI KASEI K.K.; a trade name Roica SC Type) of 40 deniers (44 dtex) and nylon fiber of 50 deniers (56 dtex)/68 filaments in the same manner as in Example 15, and spats were formed therefrom. The estimation was made on the spats in the same manner as in Example 1, results of which are shown in Table 4. The spats were unsatisfactory in stuffiness and clinginess.

Comparative Example 12

A stretch fabric was prepared from the polyurethane elastic fiber (available from ASAHI KASEI K.K.; a trade name Roica SC Type) of 20 deniers (22 dtex)/2 filaments and nylon 66 fiber of 20 deniers (22 dtex)/24 filaments in the same manner as in Example 16, and shorts were formed therefrom. The estimation was made on the shorts in the same manner as in Example 1, results of which are shown in Table 4. The shorts were unsatisfactory in stuffiness and clinginess.

Comparative Example 13

A stretch fabric was prepared from the polyurethane elastic fiber (available from ASAHI KASEI K.K.; a trade name Roica SC Type) of 20 deniers (22 dtex)/2 filaments and nylon 66 fiber of 20 deniers (22 dtex)/24 filaments in the same manner as in Example 17, and shorts were formed therefrom. The estimation was made on the shorts in the same manner as in Example 1, results of which are shown in Table 4. The shorts were unsatisfactory in stuffiness and clinginess.

TABLE 4

| | Example 13 | Example 14 | Example 15 | Example 16 | Example 17 | Comparative example 9 | Comparative example 10 |
|---|---|---|---|---|---|---|---|
| Basis weight g/m$^2$ | 140 | 190 | 230 | 50 | 60 | 140 | 190 |
| Mixing ratio of polyurethane-urea elastic fiber % | 18.6 | 20.0 | 20.5 | 10.6 | 25.0 | 18.6 | 20.0 |
| Moisture-absorption ratio of elastic fiber in atmosphere A (% by weight) | 2.0 | 2.0 | 2.0 | 2.7 | 2.7 | 1.0 | 1.0 |
| Moisture-absorption ratio of elastic fiber in atmosphere B (% by weight) | 11.0 | 11.0 | 11.0 | 16.6 | 16.6 | 1.5 | 1.5 |
| Difference in moisture-absorption ratio of elastic fiber between atmospheres A and B (% by weight) | 9.0 | 9.0 | 9.0 | 13.9 | 13.9 | 0.5 | 0.5 |
| Wearing comfort | | | | | | | |
| No stuffiness or clinginess is felt | 4.5 | 4.3 | 4.5 | 4.2 | 4.8 | 2.1 | 1.8 |
| Skin touch is good | 4.0 | 4.1 | 4.0 | 4.1 | 4.0 | 3.8 | 3.5 |
| There is a dry feeling | 4.8 | 4.2 | 4.7 | 4.6 | 4.8 | 2.5 | 2.2 |
| Stretchability is good | 4.0 | 4.4 | 4.5 | 4.0 | 4.5 | 3.1 | 3.0 |
| Supporting force is good | 4.3 | 4.8 | 4.8 | 3.8 | 4.3 | 3.0 | 2.7 |
| There is a wearing comfort | 4.4 | 4.2 | 4.6 | 4.1 | 4.5 | 2.5 | 2.3 |

| | Comparative example 11 | Comparative example 12 | Comparative example 13 |
|---|---|---|---|
| Basis weight g/m$^2$ | 230 | 50 | 60 |
| Mixing ratio of polyurethane-urea elastic fiber % | 20.5 | 10.6 | 25.0 |
| Moisture-absorption ratio of elastic fiber in atmosphere A (% by weight) | 1.0 | 1.0 | 2.7 |
| Moisture-absorption ratio of elastic fiber in atmosphere B (% by weight) | 1.5 | 1.5 | 1.5 |
| Difference in moisture-absorption ratio of elastic fiber between atmospheres A and B (% by weight) | 0.5 | 0.5 | 0.5 |
| Wearing comfort | | | |
| No stuffiness or clinginess is felt | 1.2 | 2.7 | 2.5 |
| Skin touch is good | 3.0 | 3.2 | 3.8 |
| There is a dry feeling | 1.8 | 2.8 | 2.0 |
| Stretchability is good | 2.8 | 2.2 | 2.8 |
| Supporting force is good | 2.5 | 1.5 | 2.0 |
| There is a wearing comfort | 2.0 | 1.9 | 2.4 |

CAPABILITY OF EXPLOITATION IN INDUSTRY

According to the present invention, a high elongation and high stretch recovery synthetic fiber such as polyurethane fiber or polyurethane-urea fiber is obtainable and is capable of releasing moisture absorbed therein, which strength does not reduce so large even when moistened. Also, the high elongation and high stretch-recovery fiber according to the present invention is capable of forming a stretchable fabric mixed with other fiber which strength does not reduce so large even in a wet treatment such as a dyeing process and has a high color fastness to rubbing in a wet condition. Thus, the present invention can provide a stretchable clothing excellent in wear comfort and free from a stuffy feel.

What is claimed is:

1. A moisture-absorbable synthetic fiber with an improved moisture releasing property exhibiting a high elongation and high stretch-recovery, characterized in that it has a moisture absorption ratio in a range from 0.5 to 4.0% by weight in an environment of 20° C.×65% RH and that of 4.5% by weight or more in an environment of 30° C.×90% RH, respectively, and has a difference between the absorption ratios in both the environments of 4.0% by weight or more.

2. A moisture-absorbable synthetic fiber with an improved moisture releasing property exhibiting a high elongation and high stretch-recovery as defined by claim 1, wherein the moisture absorption ratio in the environment of 30° C.×90% RH is in a range from 4.5 to 30% by weight.

3. A moisture-absorbable synthetic fiber with an improved moisture releasing property exhibiting a high elongation and high stretch-recovery defined by claim 1 or 2 wherein the synthetic fiber is polyurethane type synthetic fiber or polyether-ester type synthetic fiber.

4. A moisture-absorbable synthetic fiber with an improved moisture releasing property exhibiting a high elongation and high stretch-recovery defined by claim 3, wherein the synthetic fiber is polyurethane type synthetic fiber obtained by a dry spinning.

5. A moisture-absorbable synthetic fiber with an improved moisture releasing property exhibiting a high elongation and high stretch-recovery defined by claim 4, wherein a retaining ratio of a strength at break in the environment of 30° C.×90% RH relative to that in the environment of 20° C.×65% RH in the polyurethane type synthetic fiber is 90% or more.

6. A moisture-absorbable synthetic fiber with an improved moisture releasing property exhibiting a high elongation and high stretch-recovery defined by claim 4 or 5, wherein the polyurethane type synthetic fiber has a color fastness to rubbing in a wet condition of grade 4 or higher when dyed with acid dye.

7. A moisture-absorbable synthetic fiber with an improved moisture releasing property exhibiting a high elongation and high stretch-recovery defined by any one of claims 4 to 6, wherein the polyurethane type synthetic fiber contains water absorption resin in a range from 5 to 40% by weight relative to polyurethane type polymer, which resin has a water absorption ratio in a range from 500 to 4000% by weight.

8. A moisture-absorbable synthetic fiber with an improved moisture releasing property exhibiting a high elongation and high stretch-recovery defined by claim 7, wherein the water absorption resin is at least one of urethane type water absorption resins obtained by the reaction of the following components (a) and (b) or (a) to (c):

(a) High molecular-weight diol containing at least 50% by weight of polyalkylene ether glycol having a number-average molecular weight in a range from 2000 to 30000 in which ethylene oxide unit is contained at least 70% by weight;

(b) organic diisocyanate; and (c) low molecular-weight diol having a number-average molecular weight in a range from 50 to 200, or bifunctional amine.

9. A moisture-absorbable synthetic fiber with an improved moisture releasing property exhibiting a high elongation and high stretch-recovery defined by claim 8, wherein the high molecular-weight diol is polyethylene glycol; the organic diisocyanate is at least one of 4, 4'-diphenylmethane diisocyanate and 4,4'-dicyclohexylmethane diisocyanate; the low molecular-weight diol is at least one of 1,4-butane diol and ethylene glycol; and the bifunctional amine is at least one of ethylene diamine and 1,2-propylene diamine.

10. A moisture-absorbable synthetic fiber with an improved moisture releasing property exhibiting a high elongation and high stretch-recovery defined by any one of claims 7 to 9, wherein the urethane type synthetic fiber contains urea compound obtained by the reaction of the following components (A) to (C) in a range from 1 to 15% by weight relative to the polyurethane type polymer (A) Nitrogen-contained compound containing bifunctional amino group selected from primary amine and secondary amine and nitrogen-contained group selected from tertiary nitrogen and heterocyclic nitrogen;

(B) organic diisocyanate; and (C) compound selected from mono- or di-alkylmonoamine, alkylmonoalcohol and organic monoisocyanate.

11. A moisture-absorbable synthetic fiber with an improved moisture releasing property exhibiting a high elongation and high stretch-recovery defined by any one of claims 4 to 10, wherein the polyurethane type synthetic fiber is polyurethane-urea elastic fiber composed of polyurethane-urea polymer obtained by reacting polyalkyleneether glycol having a number average molecular weight in a range from 500 to 10,000 with an excessive molar amount of organic diisocyanate to result in a prepolymer having isocyanate groups at both ends, which is then reacted with bifunctional amine and monofunctional amine.

12. A method for producing a moisture-absorbable synthetic fiber with an improved moisture releasing property exhibiting a high elongation and high stretch-recovery, wherein polyurethane-urea elastic fiber is obtained from polyurethane-urea polymer obtained by reacting polyalkyleneether glycol having a number average molecular weight in a range from 500 to 10,000 with an excessive molar amount of organic diisocyanate to result in a prepolymer having isocyanate groups at both ends, which then reacts with bifunctional amine and monofunctional amine, characterized in that a polyurethane-urea spinning dope obtained by dissolving or micro-dispersing in an amide type polar solvent at least one urethane type water absorption resin in a range from 1 to 15% by weight relative to polyurethane-urea polymer, which resin has a water absorption ratio in a range from 500 to 4000% by weight and obtained by reacting the following components (a) and (b) or (a) to (c) with each other:

(a) High molecular-weight diol containing at least 50% by weight of polyalkylene ether glycol having a number-average molecular weight in a range from 2000 to 30000 in which ethylene oxide unit is contained at least 70% by weight;

(b) organic diisocyanate; and (c) low molecular-weight diol having a number-average molecular weight in a range from 50 to 200, or bifunctional amine.

13. A method for producting a moisture-absorbable synthetic fiber with an improved moisture releasing property exhibiting a high elongation and high stretch-recovery defined by claim 12, wherein the polyurethane-urea type synthetic fiber is obtained by dissolving in an amide type polar solvent a urea compound obtained by the reaction of the following components (A) to (C) in a range from 1 to 15% by weight relative to the polyurethane-urea type polymer (A) Nitrogen-contained compound containing bifunctional amino group selected from primary amine and secondary amine and nitrogen-contained group selected from tertiary nitrogen and heterocyclic nitrogen;

(B) organic diisocyanate; and (C) compound selected from mono- or di-alkylmonoamine, alkylmonoalcohol and organic monoisocyanate.

14. A fabric composed of the moisture-absorbable synthetic fiber with an improved moisture releasing property defined by any one of claims 1 to 11.

15. A weft knit fabric composed of the moisture-absorbable synthetic fiber with an improved moisture releasing property defined by any one of claims 1 to 11.

16. A warp knit fabric composed of the moisture-absorbable synthetic fiber with an improved moisture releasing property defined by any one of claims 1 to 11.

17. A woven fabric composed of the moisture-absorbable synthetic fiber with an improved moisture releasing property defined by any one of claims 1 to 11.

18. A leg wear composed of the moisture-absorbable synthetic fiber with an improved moisture releasing property defined by any one of claims 1 to 11.

19. An under wear composed of the moisture-absorbable synthetic fiber with an improved moisture releasing property defined by any one of claims 1 to 11.

20. A sports wear composed of the moisture-absorbable synthetic fiber with an improved moisture releasing property defined by any one of claims 1 to 11.

* * * * *